US005327520A

United States Patent [19]

Chen

[11] Patent Number: 5,327,520

[45] Date of Patent: Jul. 5, 1994

[54] METHOD OF USE OF VOICE MESSAGE CODER/DECODER

[75] Inventor: Juin-Hwey Chen, Neshanic Station, N.J.

[73] Assignee: AT&T Bell Laboratories, Murray Hill, N.J.

[21] Appl. No.: 893,296

[22] Filed: Jun. 4, 1992

[51] Int. Cl.[5] ..... G10L 9/00

[52] U.S. Cl. ..... 395/2.28; 395/2.31; 395/2

[58] Field of Search ..... 381/29-53; 395/2, 2.28, 2.31

[56] References Cited

U.S. PATENT DOCUMENTS

| | | | |
|---|---|---|---|
| 4,048,443 | 9/1987 | Crochiere et al. | 179/13 A |
| 4,899,385 | 2/1990 | Ketchum et al. | 381/36 |
| 4,963,034 | 10/1990 | Cuperman et al. | 381/30 |
| 4,969,192 | 11/1990 | Chen et al. | 381/31 |
| 5,086,471 | 2/1992 | Tanaka et al. | 381/31 |
| 5,142,583 | 8/1992 | Galand et al. | 381/38 |
| 5,173,941 | 12/1992 | Yip et al. | 381/36 |

OTHER PUBLICATIONS

Parsons, Thomas W., *Voice and Speech Processing*, McGraw-Hill Book Co., 1986, pp. 154-159.

S. Rangnekar and M. Hossain, "AT&T Voice Mail Service," *AT&T Technology*, vol. 5, No. 4, 1990, pp. 28-29.

A. Ramirez, "From the Voice-Mail Acom, a Still--Spreading Oak," *NY Times*, May 3, 1992 2 pages.

J. G. Josenhans, J. F. Lynch, Jr., M. R. Rogers, R. R. Rosinski, and W. P. VanDame, "Report: Speech Processing Application Standards," AT&T Technical Journal, vol. 65, No. 5, Sep./Oct. 1986, pp. 23-33.

N. S. Jayant and P. Noll, "Digital Coding of Waveforms-Principles and Applications to Speech and Video", 1984, Whole Book.

J-H Chen, "A robust low-delay CELP speech coder at 16 kbit/s," Proc. Globecom, pp. 1237-1241 (Nov. 1989).

J-H Chen, "High Quality 16 kb/s speech coding with a one-way delay less than 2 ms," Proc. ICASSP, pp. 453-456 (Apr. 1990).

J-H Chen, M. J. Melchner, R. V. Cox and D. O. Bowker, "Real-time implementation of a 16 kb/s low-delay CELP speech coder," ICASSP, pp. 181-184 (Apr. 1990).

"Draft Recommendation on 16 kbit/s Voice Coding," (hereinafter the Draft CCITT Standard Document) submitted to the CCITT Study Group XV in its meeting in Geneva, Switzerland during Nov. 11-22, 1991, pp. 1-37.

*Primary Examiner*—Michael R. Fleming
*Assistant Examiner*—Michelle Doerrler
*Attorney, Agent, or Firm*—W. Ryan; D. M. Rosenblatt

[57] ABSTRACT

A code excited linear predictive coder and decoder well suited to speech recording, transmission and reproduction, especially in voice messaging systems, provides backward adaptive gain control of stored codevectors to be applied to a synthesis filter prior to being compared with sequences of input speech signals. Simplified linear predictive parameter quantization using efficient table lookup procedures, efficient codevector storage and search all contribute in an illustrative embodiment to high quality coding and decoding with reduced computational complexity.

45 Claims, 8 Drawing Sheets

METHOD OF USE OF VOICE MESSAGE CODER/DECODER

CROSS-REFERENCE TO RELATED APPLICATION

An application entitled "Voice Message Synchronization" by David O. Anderton filed of even date herewith is related to the subject matter of the present application.

FIELD OF THE INVENTION

This invention relates to voice coding and decoding. More particularly this invention relates to digital coding of voice signals for storage and transmission, and to decoding of digital signals to reproduce voice signals.

BACKGROUND OF THE INVENTION

Recent advances in speech coding coupled with a dramatic increase in the performance-to-price ratio for Digital Signal Processor (DSP) devices have significantly improved the perceptual quality of compressed speech in speech processing systems such as voice store-and-forward systems or voice messaging systems. Typical applications of such voice processing systems are described in S. Rangnekar and M. Hossain, "AT&T Voice Mail Service," AT&T Technology, Vol. 5, No. 4, 1990 and in A. Ramirez, "From the Voice-Mail Acorn, a Still-Spreading Oak," NY Times, May 3, 1992.

Speech coders used in voice messaging systems provide speech compression for reducing the number of bits required to represent a voice waveform. Speech coding finds application in voice messaging by reducing the number of bits that must be used to transmit a voice message to a distant location or to reduce the number of bits that must be stored to recover a voice message at some future time. Decoders in such systems provide the complementary function of expanding stored or transmitted coded voice signals in such manner as to permit reproduction of the original voice signals.

Salient attributes of a speech coder optimized for transmission include low bit rate, high perceptual quality, low delay, robustness to multiple encodings (tandeming), robustness to bit-errors, and low cost of implementation. A coder optimized for voice messaging, on the other hand, advantageously emphasizes the same low bit rate, high perceptual quality, robustness to multiple encodings (tandeming) and low cost of implementation, but also provides resilience to mixed-encodings (transcoding).

These differences arise because, in voice messaging, speech is encoded and stored using mass storage media for recovery at a later time. Delays of up to a few hundred milliseconds in encoding or decoding are unobservable to a voice messaging system user. Such large delays in transmission applications, on the other hand, can cause major difficulties for echo cancellation and disrupt the natural give-and-take of two-way real time conversations. Furthermore, the high reliability of mass storage media achieve bit error rates several orders of magnitude lower than those observed on many contemporary transmission facilities. Hence, robustness to bit errors is not a primary concern for voice messaging systems.

Prior art systems for voice storage typically employ the CCITT G.721 standard 32 kb/s ADPCM speech coder or a 16 kbit/s Sub-Band coder (SBC) as described in J. G. Josenhans, J. F. Lynch, Jr., M. R. Rogers, R. R. Rosinski, and W. P. VanDame, "Report: Speech Processing Application Standards," AT&T Technical Journal, Vol. 65, No. 5, September/October 1986, pp. 23–33. More generalized aspects of SBC are described, e.g., in N. S. Jayant and P. Noll, "Digital Coding of Waveforms-Principles and Applications to Speech and Video", and in U.S. Pat. No. 4,048,443 issued to R. E. Crochiere et al. on Sep. 13, 1977.

While 32 kb/s ADPCM gives very good speech quality, its bit-rate is higher than desired. On the other hand, while 16 kbit/s SBC has half the bit-rate and has offered a reasonable tradeoff between cost and performance in prior art systems, recent advances in speech coding and DSP technology have rendered SBC less than optimum for many current applications. In particular, new speech coders are often superior to SBC in terms of perceptual quality and tandeming/transcoding performance. Such new coders are typified by so-called code excited linear predictive coders (CELP) disclosed, e.g., in U.S. patent application Ser. No. 07/298,451, by J-H Chen, filed Jan. 17, 1989, now abandoned, and U.S. patent application Ser. No. 07/757,168 by J-H. Chen, filed Sep. 10, 1991, U.S. patent application Ser. No. 07/837,509 by J-H. Chen et al., filed Feb. 18, 1992, and U.S. patent application Ser. No. 07/837,522 by J-H. Chen et al., filed Feb. 18, 1992, assigned to the assignee of the present application. Each of these applications are hereby incorporated by reference in the present application as if set forth in their entirety herein. Related coders and decoders are described in J-H Chen, "A robust low-delay CELP speech coder at 16 kbit/s," Proc. GLOBECOM, pp. 1237–1241 (November 1989); J-H Chen, "High-quality 16 kb/s speech coding with a one-way delay less than 2 ms," Proc. ICASSP, pp. 453–456 (April 1990); J-H Chen, M. J. Melchner, R. V. Cox and D. O. Bowker, "Real-time implementation of a 16 kb/s low-delay CELP speech coder," Proc. ICASSP, pp. 181–184 (April 1990); all of which papers are hereby incorporated herein by reference as if set forth in their entirety. A further description of the candidate 16 kbit/sec LD CELP standard system was presented in a document entitled "Draft Recommendation on 16 kbit/s Voice Coding," (hereinafter the Draft CCITT Standard Document) submitted to the CCITT Study Group XV in its meeting in Geneva, Switzerland during Nov. 11–22, 1991 which document is incorporated herein by reference in its entirety. In the sequel, systems of the type described in the Draft CCITT Standard Document will be referred to as LD-CELP systems.

SUMMARY OF THE INVENTION

Voice storage and transmission systems, including voice messaging systems, employing typical embodiments of the present invention achieve significant gains in perceptual quality and cost relative to prior art voice processing systems. Although some embodiments of the present invention are especially adapted for voice storage applications and therefore are to be contrasted with systems primarily adapted for use in conformance to the CCITT (transmission-optimized) standard, embodiments of the present invention will nevertheless find application in appropriate transmission applications.

Typical embodiments of the present invention are known as Voice Messaging Coders and will be referred to, whether in the singular or plural, as VMC. In an illustrative 16 kbit/s embodiment, a VMC provides speech quality comparable to 16 kbit/s LD-CELP or 32 kbit/s ADPCM (CCITT G.721) and provides good performance under tandem encodings. Further, VMC minimizes degradation for mixed encodings (transcoding) with other speech coders used in the voice messaging or voice mail industry (e.g., ADPCM, CVSD, etc.). Importantly, a plurality of encoder-decoder pair implementations of 16 kb/sec VMC algorithms can be implemented using a single AT&T DSP32C processor under program control.

VMC has many features in common with the recently adopted CCITT standard 16 kbit/s Low-Delay CELP coder (CCITT Recommendation G.728) described in the Draft CCITT Standard Document. However, in achieving its desired goals, VMC advantageously uses forward-adaptive LPC analysis as opposed to backwards-adaptive LPC analysis typically used in LD-CELP. Additionally, typical embodiments of VMC advantageously use a lower order (typically 10th order) LPC model, rather than a 50th order model for LD-CELP. VMC typically incorporates a 3-tap pitch predictor rather than the one-tap predictor used in conventional CELP. VMC uses a first order backwards-adaptive gain predictor as opposed to a 10th order predictor for LD-CELP. VMC also advantageously quantizes the gain predictor for greater stability and interoperability with implementations on different hardware platforms. In illustrative embodiments, VMC uses an excitation vector dimension of 4 rather than 5 as used in LD-CELP, thereby to achieve important computational complexity advantages. Furthermore VMC illustratively uses a 6-bit gain-shape excitation codebook, with 5-bits allocated to shape and 1-bit allocated to gain. LD-CELP, by contrast, uses a 10-bit gain-shape codebook with 7-bits allocated to shape and 3-bits allocated to gain.

DETAILED DESCRIPTION

1. Outline of VMC

Figure 1:
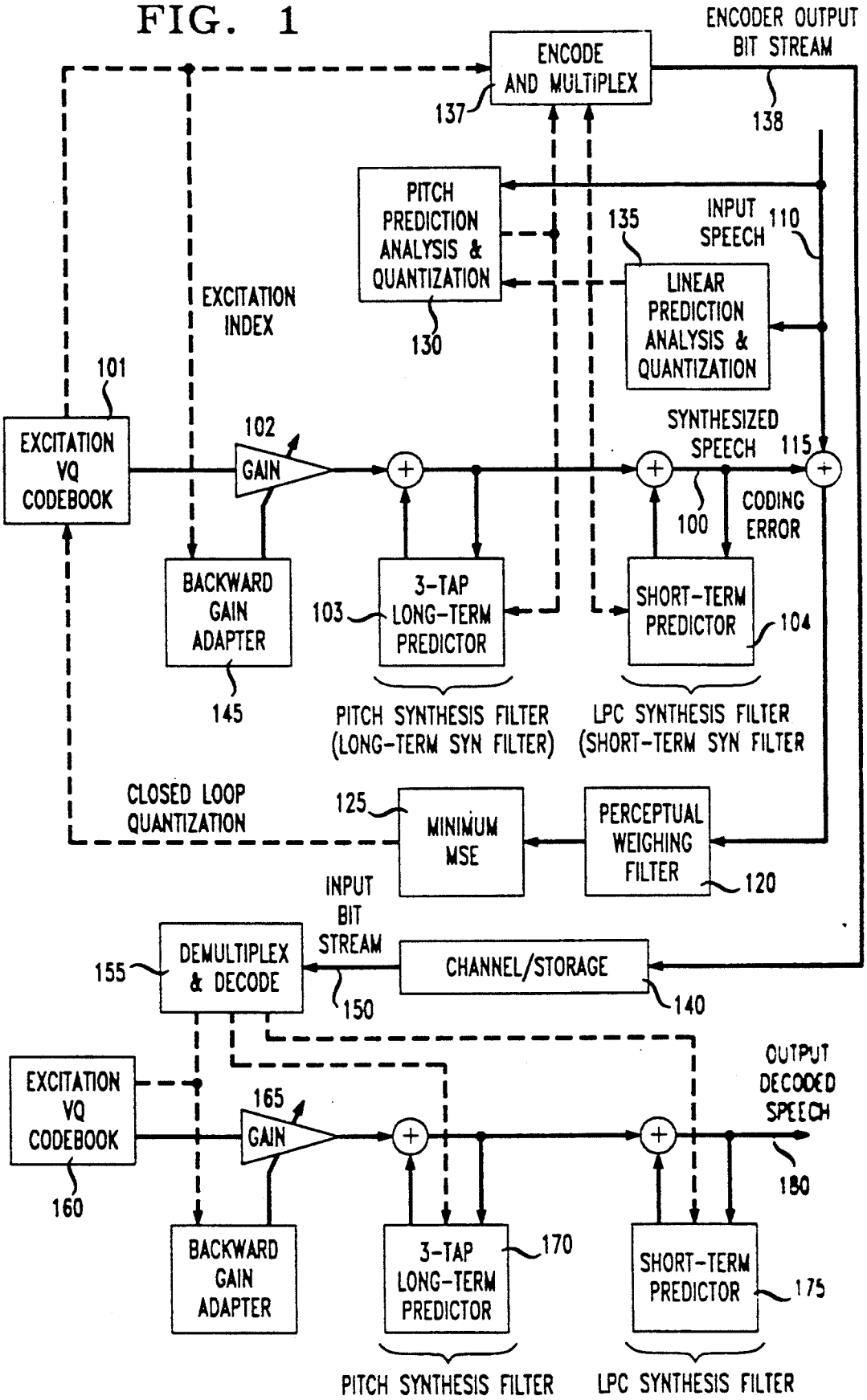
FIG. 1 is an overall block diagram of a typical embodiment of a coder/decoder pair in accordance with one aspect of the present invention.

The VMC shown in an illustrative embodiment in FIG. 1 is a predictive coder specially designed to achieve high speech quality at 16 kbit/s with moderate coder complexity. This coder produces synthesized speech on lead 100 in FIG. 1 by passing an excitation sequence from excitation codebook 101 through a gain scaler 102 then through a long-term synthesis filter 103 and a short-term synthesis filter 104. Both synthesis filters are adaptive all-pole filters containing, respectively, a long-term predictor or a short-term predictor in a feedback loop, as shown in FIG. 1. The VMC encodes input speech samples in frame-by-frame fashion as they are input on lead 110. For each frame, VMC attempts to find the best predictors, gains, and excitation such that a perceptually weighted mean-squared error between the input speech on input 110 and the synthesized speech is minimized. The error is determined in comparator 115 and weighted in perceptual weighting filter 120. The minimization is determined as indicated by block 125 based on results for the excitation vectors in codebook 101.

The long-term predictor 103 is illustratively a 3-tap predictor with a bulk delay which, for voiced speech, corresponds to the fundamental pitch period or a multiple of it. For this reason, this bulk delay is sometimes referred to as the pitch lag. Such a long-term predictor is often referred to as a pitch predictor, because its main function is to exploit the pitch periodicity in voiced speech. The short-term predictor is 104 is illustratively a 10th-order predictor. It is sometimes referred to as the LPC predictor, because it was first used in the well-known LPC (Linear Predictive Coding) vocoders that typically operate at 2.4 kbit/s or below.

The long-term and short-term predictors are each updated at a fixed rate in respective analysis and quantization elements 130 and 135. At each update, the new predictor parameters are encoded and, after being multiplexed and coded in element 137, are transmitted to channel/storage element 140. For ease of description, the term transmit will be used to mean either (1) transmitting a bit-stream through a communication channel to the decoder, or (2) storing a bit-stream in a storage medium (e.g., a computer disk) for later retrieval by the decoder. In contrast with updating of parameters for filters 103 and 104, the excitation gain provided by gain element 102 is updated in backward gain adapter 145 by using the gain information embedded in previously quantized excitation; thus there is no need to encode and transmit the gain information.

The excitation Vector Quantization (VQ) codebook 101 illustratively contains a table of 32 linearly independent code book vectors (or codevectors), each having 4 components. With an additional bit that determines the sign of each of the 32 excitation codevectors, the codebook 101 provides the equivalent of 64 codevectors that serve as candidates for each 4-sample excitation vector. Hence, a total of 6 bits are used to specify each quantized excitation vector. The excitation information, therefore, is encoded at $6/4=1.5$ bits/samples$=12$ kbit/s (8 kHz sampling is illustratively assumed). The long-term and short-term predictor information (also called side information) is encoded at a rate of 0.5 bits/sample or 4 kbit/s. Thus the total bit-rate is 16 kbit/s.

An illustrative data organization for the coder of FIG. 1 will now be described.

After the conversion from $\mu$-law PCM to uniform PCM, as may be needed, the input speech samples are conveniently buffered and partitioned into frames of 192 consecutive input speech samples (corresponding to 24 ms of speech at an 8 kHz sampling rate). For each input speech frame, the encoder first performs linear prediction analysis (or LPC analysis) on the input speech in element 135 in FIG. 1 to derive a new set of reflection coefficients. These coefficients are conveniently quantized and encoded into 44 bits as will be described in more detail in the sequel. The 192-sample speech frame is then further divided into 4 sub-frames, each having 48 speech samples (6 ms). The quantized reflection coefficients are linearly interpolated for each sub-frame and converted to LPC predictor coefficients. A 10th order pole-zero weighting filter is then derived for each sub-frame based on the interpolated LPC predictor coefficients.

For each sub-frame, the interpolated LPC predictor is used to produce the LPC prediction residual, which is, in turn, used by a pitch estimator to determine the bulk delay (or pitch lag) of the pitch predictor, and by the pitch predictor coefficient vector quantizer to determine the 3 tap weights of the pitch predictor. The pitch lag is illustratively encoded into 7 bits, and the 3 taps are illustratively vector quantized into 6 bits. Unlike the LPC predictor, which is encoded and transmitted once a frame, the pitch predictor is quantized, encoded, and transmitted once per sub-frame. Thus, for each 192-sample frame, there are a total of $44+4\times(7+6)=96$ bits allocated to side information in the illustrative embodiment of FIG. 1.

Once the two predictors are quantized and encoded, each 48-sample sub-frame is further divided into 12 speech vectors, each 4 samples long. For each 4-sample speech vector, the encoder passes each of the 64 possible excitation codevectors through the gain scaling unit and the two synthesis filters (predictors 103 and 104, with their respective summers) in FIG. 1. From the resulting 64 candidate synthesized speech vectors, and with the help of the perceptual weighting filter 120, the encoder identifies the one that minimizes a frequency-weighted mean-squared error measure with respect to the input signal vector. The 6-bit codebook index of the corresponding best codevector that produces the best candidate synthesized speech vector is transmitted to the decoder. The best codevector is then passed through the gain scaling unit and the synthesis filter to establish the correct filter memory in preparation for the encoding of the next signal vector. The excitation gain is updated once per vector with a backward adaptive algorithm based on the gain information embedded in previously quantized and gain-scaled excitation vectors. The excitation VQ output bit-stream and the side information bit-stream are multiplexer together in element 137 in FIG. 1 as described more fully in Section 5, and transmitted on output 138 (directly or indirectly via storage media) to the VMC decoder as illustrated by channel/storage element 140.

2. VMC Decoder Overview

As in the coding phase, the decoding operation is also performed on a frame-by-frame basis. On receiving or retrieving a complete frame of VMC encoded bits on input 150, the VMC decoder first demultiplexes the side information bits and the excitation bits in demultiplex and decode element 155 in FIG. 1. Element 155 then decodes the reflection coefficients and performs linear interpolation to obtain the interpolated LPC predictor for each sub-frame. The resulting predictor information is then supplied to short-term predictor 175. The pitch lag and the 3 taps of the pitch predictor are also decoded for each sub-frame and provided to long term-predictor 170. Then, the decoder extracts the transmitted excitation codevectors from the excitation codebook 160 using table look-up. The extracted excitation codevectors, arranged in sequence, are then passed through the gain scaling unit 165 and the two synthesis filters 170 and 175 shown in FIG. 1 to produce decoded speech samples on lead 180. The excitation gain is updated in backward gain adapter 168 with the same algorithm used in the encoder. The decoded speech samples are next illustratively converted from linear PCM format to $\mu$-law PCM format suitable for D/A conversion in a $\mu$-law PCM codec.

3. VMC Encoder Operation

Figure 2A:
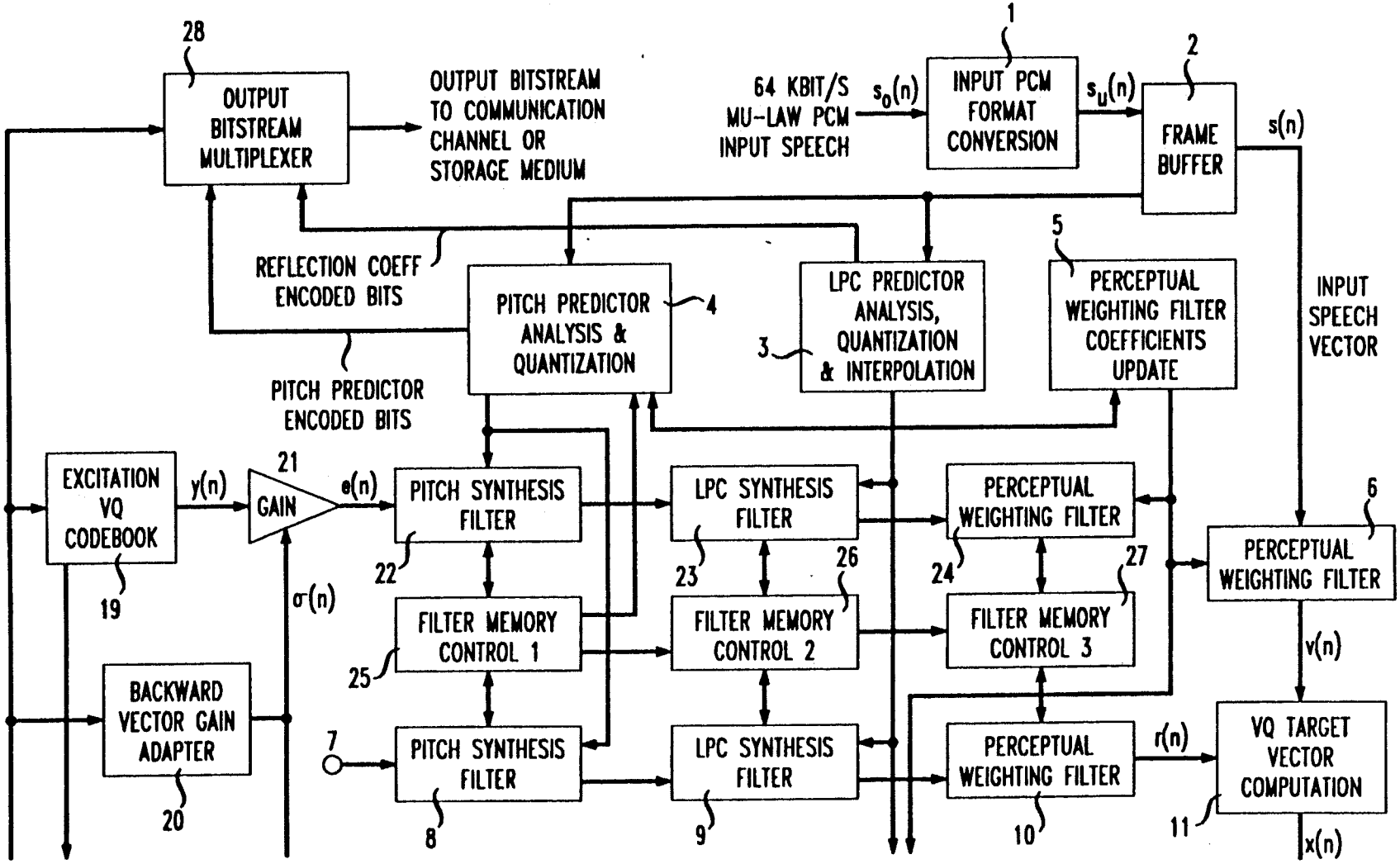
FIG. 2 is a more detailed block diagram of a coder of the type shown in FIG. 1.
Figure 2B:
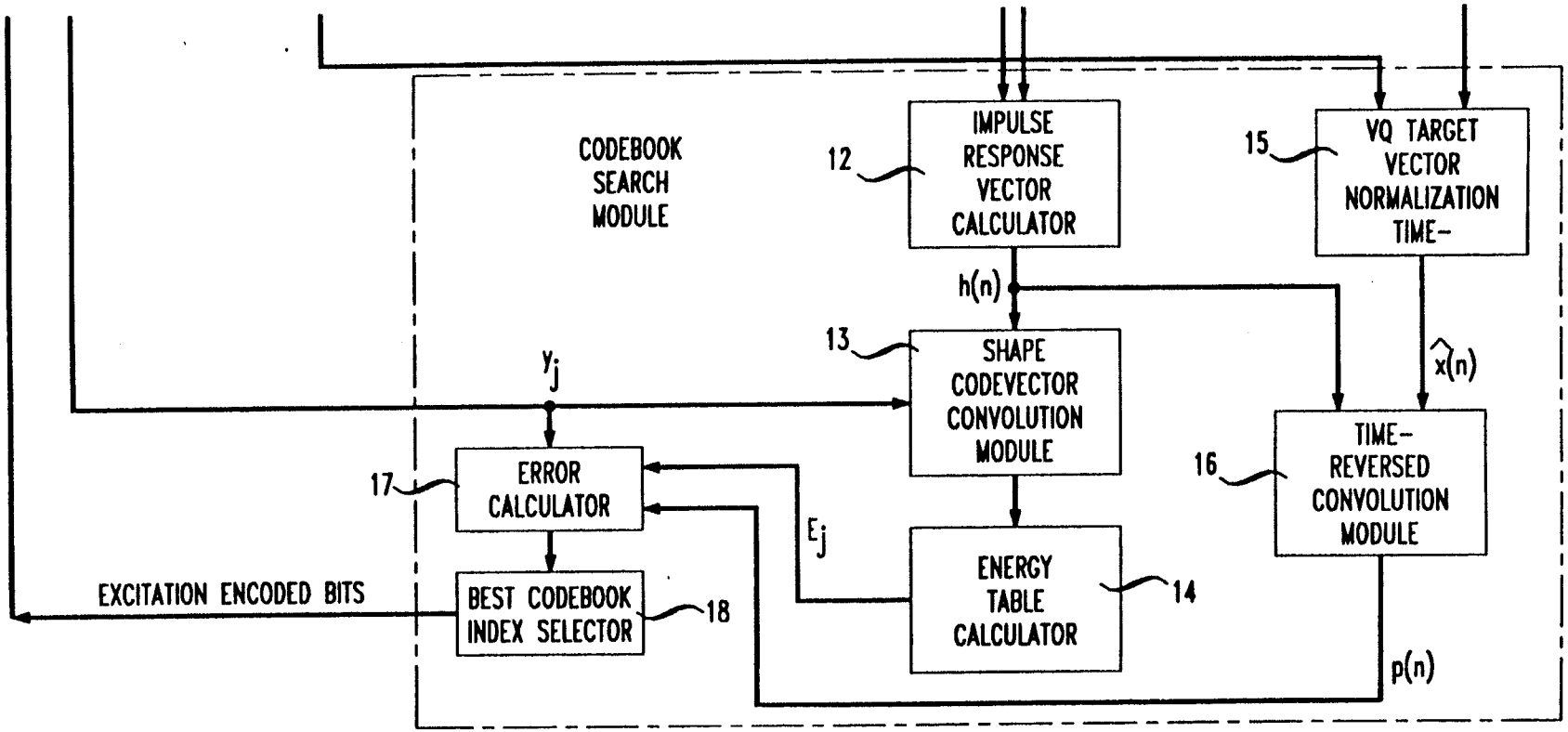
Figure 2C:
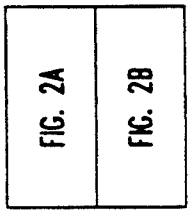

FIG. 2 is a detailed block schematic of the VMC encoder. The encoder in FIG. 2 is logically equivalent to the encoder previously shown in FIG. 1 but the system organization of FIG. 2 proves computationally more efficient in implementation for some applications.

In the following detailed description,

1. For each variable to be described, k is the sampling index and samples are taken at 125 $\mu$s intervals.
2. A group of 4 consecutive samples in a given signal is called a vector of that signal. For example, 4 consecutive speech samples form a speech vector, 4 excitation samples form an excitation vector, and so on.
3. n is used to denote the vector index, which is different from the sample index k.
4. f is used to denote the frame index.

Since the illustrative VMC coder is mainly used to encode speech, in the following description we assume that the input signal is speech, although it can be a non-speech signal, including such non-speech signals as multi-frequency tones used in communications signaling, e.g., DTMF tones. The various functional blocks in the illustrative system shown in FIG. 2 are described below in an order roughly the same as the order in which they are performed in the encoding process.

3.1 Input PCM Format Conversion, 1

This input block 1 converts the input 64 kbit/s $\mu$-law PCM signal $s_o(k)$ to a uniform PCM signal $s_u(k)$, an operation well known in the art.

3.2 Frame Buffer, 2

This block has a buffer that contains 264 consecutive speech samples, denoted $s_u(192f+1)$, $s_u(192f+2)$, $s_u(192f+3)$, . . . , $s_u(192f+264)$, where f is the frame index. The first 192 speech samples in the frame buffer are called the current frame. The last 72 samples in the frame buffer are the first 72 samples (or the first one and a half sub-frames) of the next frame. These 72 samples are needed in the encoding of the current frame, because the Hamming window illustratively used for LPC analysis is not centered at the current frame, but is advantageously centered at the fourth sub-frame of the current frame. This is done so that the reflection coefficients can be linearly interpolated for the first three sub-frames of the current frame.

Each time the encoder completes the encoding of one frame and is ready to encode the next frame, the frame buffer shifts the buffer contents by 192 samples (the oldest samples are shifted out) and then fills the vacant locations with the 192 new linear PCM speech samples of the next frame. For example, the first frame after coder start-up is designated frame 0 (with f=0). The frame buffer 2 contains $s_u(1)$, $s_u(2)$, . . . , $s_u(264)$ while encoding frame 0; the next frame is designated frame 1, and the frame buffer contains $s_u(193)$, $s_u(194)$, . . . , $s_u(456)$ while encoding frame 1, and so on.

3.3 LPC Predictor Analysis, Quantization, and Interpolation, 3

Figure 4:
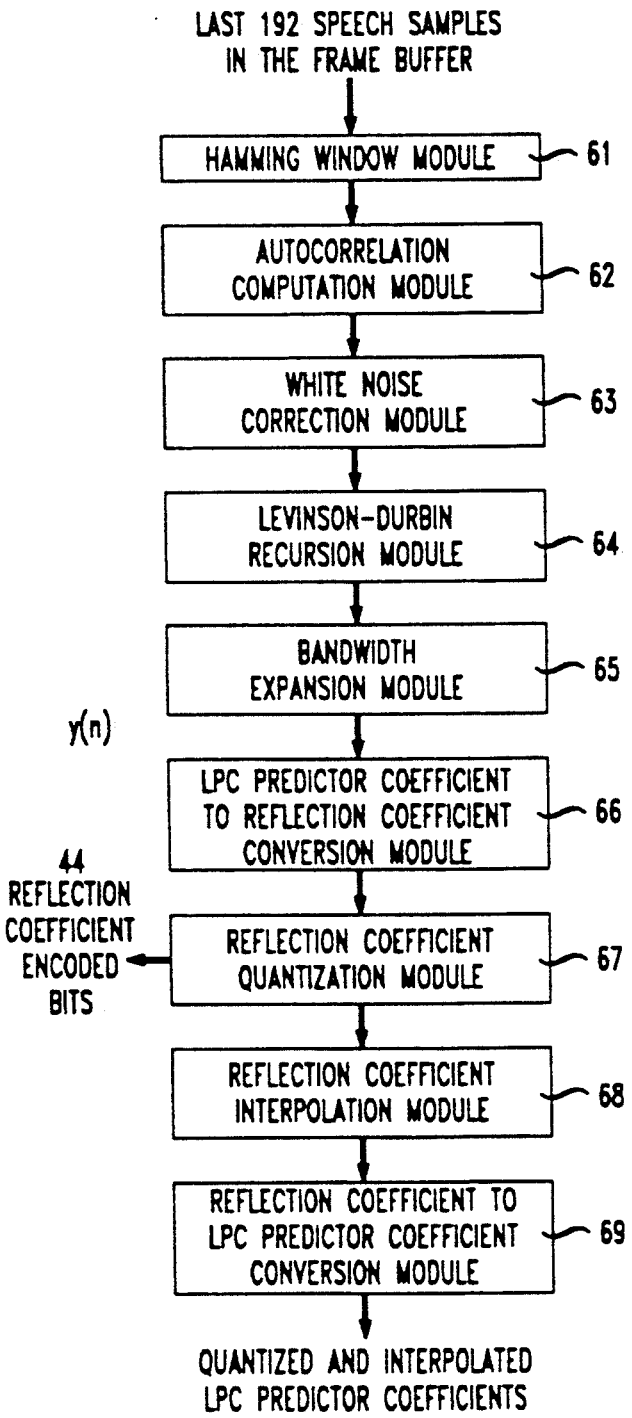
FIG. 4 is a flow chart of operations performed in the illustrative system of FIG. 1.

This block derives, quantizes and encodes the reflection coefficients of the current frame. Also, once per sub-frame, the reflection coefficients are interpolated with those from the previous frame and converted into LPC predictor coefficients. Interpolation is inhibited on the first frame following encoder initialization (reset) since there are no reflection coefficients from a previous frame with which to perform the interpolation. The LPC block (block 3 in FIG. 2) is expanded in FIG. 4; and that LPC block will now be described in more detail with reference to FIG. 4.

The Hamming window module (block 61 in FIG. 4) applies a 192-point Hamming window to the last 192 samples stored in the frame buffer. In other words, if the output of the Hamming window module (or the window-weighted speech) is denoted by ws(1), ws(2), . . . , ws(192), then the weighted samples are computed according to the following equation.

$$ws(k)=s_u(192f+72+k)[0.54-0.46\cos(2\pi(k-1)/191)],\ k=1, 2, \ldots, 192. \quad (1)$$

The autocorrelation computation module (block 62) then uses these window-weighted speech samples to compute the autocorrelation coefficients R(0), R(1), R(2), . . . , R(10) based on the following equation.

$$R(i) = \sum_{k=1}^{192-i} ws(k)ws(k+i),\ i = 0, 1, 2, \ldots, 10. \quad (2)$$

To avoid potential ill-conditioning in the subsequent Levinson-Durbin recursion, the spectral dynamic range of the power spectral density based on R(0), R(1), R(2), . . . , R(10) is advantageously controlled. An easy way to achieve this is by white noise correction. In principle, a small amount of white noise is added to the {ws(k)} sequence before computing the autocorrelation coefficients; this will fill up the spectral valleys with white noise, thus reducing the spectral dynamic range and alleviating ill-conditioning. In practice, however, such an operation is mathematically equivalent to increasing the value of R(0) by a small percentage. The white noise correction module (block 63) performs this function by slightly increasing R(0) by a factor of w.

$$R(0) \leftarrow wR(0) \quad (3)$$

Since this operation is only done in the encoder, different implementations of VMC can use different WNCF without affecting the inter-operability between coder implementations. Therefore, fixed-point implementations may, e.g., use a larger WNCF for better conditioning, while floating-point implementations may use a smaller WNCF for less spectral distortion from white noise correction. A suggested typical value of WNCF for 32-bit floating-point implementations is 1.0001. The suggested value of WNCF for 16-bit fixed-point implementations is (1+1/256). This later value of (1+1/256) corresponds to adding white noise at a level 24 dB below the average speech power. It is considered the maximum reasonable WNCF value, since too much white noise correction will significantly distort the frequency response of the LPC synthesis filter (sometimes called LPC spectrum) and hence coder performance will deteriorate.

The well-known Levinson-Durbin recursion module (block 64) recursively computes the predictor coefficients from order 1 to order 10. Let the j-th coefficients of the i-th order predictor be denoted by $a_j^{(i)}$, and let the i-th reflection coefficient be denoted by $k_i$. Then, the recursive procedure can be specified as follows:

$$E(0) = R(0) \quad (4a)$$

$$k_i = \frac{R(i) + \sum_{j=1}^{i-1} a_j^{(i-1)}R(i-j)}{E(i-1)} \quad (4b)$$

$$a_i^{(i)} = k_i \quad (4c)$$

$$a_j^{(i)} = a_j^{(i-1)} + k_i a_{i-j}^{(i-1)},\ 1 \leqq j \leqq i-1 \quad (4d)$$

$$E(i) = (1-k_i^2)E(i-1). \quad (4e)$$

Equations (4b) through (4e) are evaluated recursively for i=1, 2, . . . , 10, and the final solution is given by $$\tilde{a}_i = a_i^{(10)},\ 1 \leqq i \leqq 10. \quad (4f)$$

If we define $\tilde{a}_0=1$, then the 10-th order prediction-error filter (sometimes called inverse filter, or analysis filter) has the transfer function $$\tilde{A}(z) = \sum_{i=0}^{10} \tilde{a}_i z^{-i}, \quad (4g)$$

and the corresponding 10-th order linear predictor is defined by the following transfer function $$\tilde{P}(z) = -\sum_{i=1}^{10} \tilde{a}_i z^{-i}. \quad (4h)$$

The bandwidth expansion module (block 65) advantageously scales the unquantized LPC predictor coefficients ($\tilde{a}_i$'s in Eq. (4f)) so that the 10 poles of the corresponding LPC synthesis filter are scaled radially toward the origin by an illustrative constant factor of $\gamma=0.9941$. This corresponds to expanding the bandwidths of LPC spectral peaks by about 15 Hz. Such an operation is useful in avoiding occasional chirps in the coded speech caused by extremely sharp peaks in the LPC spectrum. The bandwidth expansion operation is defined by $$\hat{a}_i = \tilde{a}_i \gamma^i,\ i=0, 1, 2, 3, \ldots, 10, \quad (5)$$

where $\gamma=0.9941$.

The next step is to convert the bandwidth-expanded LPC predictor coefficients to reflection coefficients for quantization (done in block 66). This is done by a standard recursive procedure, going from order 10 back down to order 1. Let $\hat{k}_m$ be the m-th reflection coefficient and $a_i^{(m)}$ be the i-th coefficient of the m-th order predictor. The recursion goes as follows. For m=10, 9, 8, . . . , 1, evaluate the following two expressions:

$$\hat{k}_m = \hat{a}_m^{(m)} \quad (6a)$$

$$\hat{a}_i^{(m-1)} = \frac{\hat{a}_i^{(m)} - \hat{k}_m \hat{a}_{m-i}^{(m)}}{1-\hat{k}_m^2},\ i = 1, 2, \ldots, m-1. \quad (6b)$$

The 10 resulting reflection coefficients are then quantized and encoded into 44 bits by the reflection coefficient quantization module (block 67). The bit allocation is 6,6,5,5,4,4,4,4,3,3 bits for the first through the tenth reflection coefficients (using 10 separate scalar quantizers). Each of the 10 scalar quantizers has two pre-computed and stored tables associated with it. The first table contains the quantizer output levels, while the second table contains the decision thresholds between adjacent quantizer output levels (i.e. the boundary values between adjacent quantizer cells). For each of the 10 quantizers, the two tables are advantageously obtained by first designing an optimal non-uniform quantizer using arc sine transformed reflection coefficients as training data, and then converting the arc sine domain quantizer output levels and cell boundaries back to the regular reflection coefficient domain by applying the sine function. An illustrative table for each of the two groups of reflection coefficient quantizer data are given in Appendices A and B.

The use of the tables will be seen to be in contrast with the usual arc sine transformation calculations for each reflection coefficient. Thus transforming the reflection coefficients to the arc sine transform domain where they would be compared with quantization levels to determine the quantization level having the minimum distance to the presented value is avoided in accordance with an aspect of the present invention. Likewise a transform of the selected quantization level back to the reflection coefficient domain using a sine transform is avoided.

The illustrative quantization technique used provides instead for the creation of the tables of the type appearing in Appendices A and B, representing the quantizer output levels and the boundary levels (or thresholds) between adjacent quantizer levels.

During encoding, each of the 10 unquantized reflection coefficients is directly compared with the elements of its individual quantizer cell boundary table to map it into a quantizer cell. Once the optimal cell is identified, the cell index is then used to look up the corresponding quantizer output level in the output level table. Furthermore, rather than sequentially comparing against each entry in the quantizer cell boundary table, a binary tree search can be used to speed up the quantization process.

For example, a 6-bit quantizer has 64 representative levels and 63 quantizer cell boundaries. Rather than sequentially searching through the cell boundaries, we can first compare with the 32nd boundaries to decide whether the reflection coefficient lies in the upper half or the lower half. Suppose it is in the lower half, then we go on to compare with the middle boundary (the 16th) of the lower half, and keep going like this unit until we finish the 6th comparison, which should tell us the exact cell the reflection coefficient lies. This is considerably faster than the worst case of 63 comparisons in sequential search.

Note that the quantization method described above should be followed strictly to achieve the same optimality as an arc sine quantizer. In general, different quantizer output will be obtained if one uses only the quantizer output level table and employs the more common method of distance calculation and minimization. This is because the entries in the quantizer cell boundary table are not the mid-points between adjacent quantizer output levels.

Once all 10 reflection coefficients are quantized and encoded into 44 bits, the resulting 44 bits are passed to the output bit-stream multiplexer where they are multiplexed with the encoded pitch predictor and excitation information.

For each sub-frame of 48 speech samples (6 ms), the reflection coefficient interpolation module (block 68) performs linear interpolation between the quantized reflection coefficients of the current frame and those of the previous frame. Since the reflection coefficients are obtained with the Hamming window centered at the fourth sub-frame, we only need to interpolate the reflection coefficients for the first three sub-frames of each frame. Let $\bar{k}_m$ and $\hat{k}_m$ be the m-th quantized reflection coefficients of the previous frame and the current frame, respectively, and let $k_m(j)$ be the interpolated m-th reflection coefficient for the j-th sub-frame. Then, $k_m(j)$ is computed as $$k_m(j) = \left(1 - \frac{j}{4}\right)\bar{k}_m + \frac{j}{4}\hat{k}_m,\ m = 1, 2, \ldots, 10, \tag{7}$$

and $$j = 1, 2, 3, 4.$$

Note that interpolation is inhibited on the first frame following encoder initialization (reset).

The last step is to use block 69 to convert the interpolated reflection coefficients for each sub-frame to the corresponding LPC predictor coefficients. Again, this is done by a commonly known recursive procedure, but this time the recursion goes from order 1 to order 10. For simplicity of notation, let us drop the sub-frame index j, and denote the m-th reflection coefficient by $k_m$. Also, let $a_i^{(m)}$ be the i-th coefficient of the m-th order LPC predictor. Then, the recursion goes as follows. With $a_0^{(0)}$ defined as 1, evaluate $a_i^{(m)}$ according to the following equation for m=1, 2, . . . , 10.

$$a_i^{(m)} = \begin{cases} a_i^{(m-1)}, \text{ if } i = 0 \\ a_i^{(m-1)} + k_m a_{m-i}^{(m-1)}, \text{ if } i = 1, 2, \ldots, m-1 \\ k_m, \text{ if } i = m \end{cases} \tag{8}$$

The final solution is given by $$a_0 = 1,$$

$$a_i = a_i^{(10)},\ i = 1, 2, \ldots, 10. \tag{9}$$

The resulting $a_i$'s are the quantized and interpolated LPC predictor coefficients for the current sub-frame. These coefficients are passed to the pitch predictor analysis and quantization module, the perceptual weighting filter update module, the LPC synthesis filter, and the impulse response vector calculator.

Based on the quantized and interpolated LPC coefficients, we can define the transfer function of the LPC inverse filter as $$A(z) = \sum_{i=0}^{10} a_i z^{-i}, \tag{10}$$

and the corresponding LPC predictor is defined by the following transfer function $$P_2(z) = -\sum_{i=1}^{10} a_i z^{-i}. \tag{11}$$

The LPC synthesis filter has a transfer function of $$F_2(z) = \frac{1}{\sum_{i=0}^{10} a_i z^{-i}}. \tag{12}$$

3.4 Pitch Predictor Analysis and Quantization, 4

Figure 5:
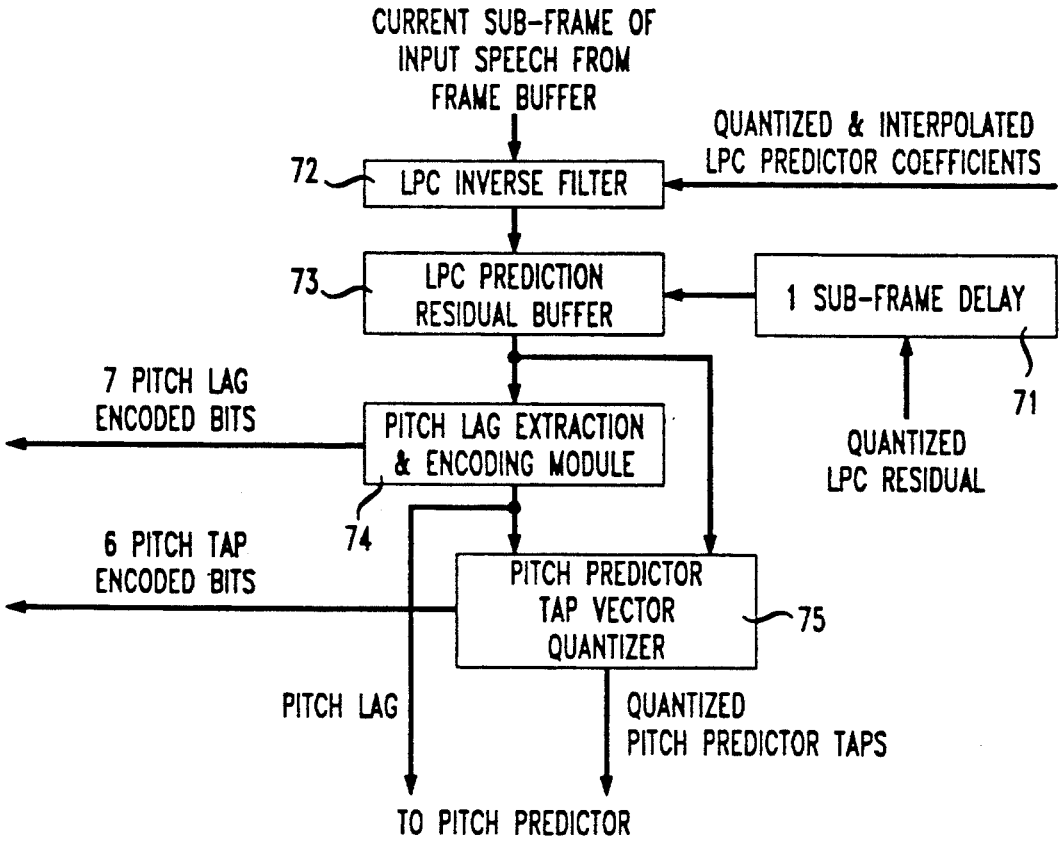
FIG. 5 is a more detailed block diagram of the predictor analysis and quantization elements of the system of FIG. 1.

The pitch predictor analysis and quantization block 4 in FIG. 2 extracts the pitch lag and encodes it into 7 bits, and then vector quantizes the 3 pitch predictor taps and encodes them into 6 bits. The operation of this block is done once each sub-frame. This block (block 4 in FIG. 2) is expanded in FIG. 5. Each block in FIG. 5 will now be explained in more detail.

The 48 input speech samples of the current sub-frame (from the frame buffer) are first passed through the LPC inverse filter (block 72) defined in Eq. (10). This results in a sub-frame of 48 LPC prediction residual samples.

$$d(k) = s_u(k) + \sum_{i=1}^{10} a_i s_u(k-i),\ k = 1, 2, \ldots, 48. \tag{13}$$

These 48 residual samples then occupy the current sub-frame in the LPC prediction residual buffer 73.

The LPC prediction residual buffer (block 73) contains 169 samples. The last 48 samples are the current sub-frame of (unquantized) LPC prediction residual samples obtained above. However, the first 121 samples d(−120), d(−119), . . . , d(0) are populated by quantized LPC prediction residual samples of previous sub-frames, as indicated by the 1 sub-frame delay block 71 in FIG. 5. (The quantized LPC prediction residual is defined as the input to the LPC synthesis filter.) The reason to use quantized LPC residual to populate the previous sub-frames is that this is what the pitch predictor will see during the encoding process, so it makes sense to use it to derive the pitch lag and the 3 pitch predictor taps. On the other hand, because the quantized LPC residual is not yet available for the current sub-frame, we obviously cannot use it to populate the current sub-frame of the LPC residual buffer; hence, we must use the unquantized LPC residual for the current frame.

Once this mixed LPC residual buffer is loaded, the pitch lag extraction and encoding module (block 74) uses it to determine the pitch lag of the pitch predictor. While a variety of pitch extraction algorithms with reasonable performance can be used, an efficient pitch extraction algorithm with low implementation complexity that has proven advantageous will be described.

This efficient pitch extraction algorithm works in the following way. First, the current sub-frame of the LPC residual is lowpass filtered (e.g., 1 kHz cut-off frequency) with a third-order elliptic filter of the form.

$$L(z) = \frac{\sum_{i=0}^{3} b_i z^{-i}}{1 + \sum_{i=1}^{3} a_i z^{-i}} \tag{13a}$$

and then 4:1 decimated (i.e. down-sampled by a factor of 4). This results in 12 lowpass filtered and decimated LPC residual samples, denoted $\bar{d}(1), \bar{d}(2), \ldots, \bar{d}(12)$, which are stored in the current sub-frame (12 samples) of a decimated LPC residual buffer. Before these 12 samples, there are 30 more samples $\bar{d}(-29), \bar{d}(-28), \ldots, \bar{d}(0)$ in the buffer that are obtained by shifting previous sub-frames of decimated LPC residual samples. The i-th cross-correlation of the decimated LPC residual samples are then computed as $$\rho(i) = \sum_{n=1}^{12} \bar{d}(n)\bar{d}(n-i) \tag{14}$$

for time lags i=5, 6, 7, . . . , 30 (which correspond to pitch lags from 20 to 120 samples). The time lag $\tau$ that gives the largest of the 26 calculated cross-correlation values is then identified. Since this time lag $\tau$ is the lag in the 4:1 decimated residual domain, the corresponding time lag that yields the maximum correlation in the original undecimated residual domain should lie between $4\tau-3$ and $4\tau+3$. To get the original time resolution, we next use the undecimated LPC residual to compute the cross-correlation of the undecimated LPC residual $$C(i) = \sum_{k=1}^{48} d(k)d(k-i) \tag{15}$$

for 7 lags $i=4\tau-3, 4\tau-2, \ldots, 4\tau+3$. Of the 7 possible lags, the lag p that gives the largest cross-correlation C(p) is the output pitch lag to be used in the pitch predictor. Note that the pitch lag obtained this way could turn out to be a multiple of the true fundamental pitch period, but this does not matter, since the pitch predictor still works well with a multiple of the pitch period as the pitch lag.

Since there are only 101 possible pitch periods (20 to 120) in the illustrative implementation, 7 bits are sufficient to encode this pitch lag without distortion. The 7 pitch lag encoded bits are passed to the output bitstream multiplexer once a sub-frame.

The pitch lag (between 20 and 120) is passed to the pitch predictor tap vector quantizer module (block 75), which quantizes the 3 pitch predictor taps and encodes them into 6 bits using a VQ codebook with 64 entries. The distortion criterion of the VQ codebook search is the energy of the open-loop pitch prediction residual, rather than a more straightforward mean-squared error of the three taps themselves. The residual energy criterion gives better pitch prediction gain than the coefficient MSE criterion. However, it normally requires much higher complexity in the VQ codebook search, unless a fast search method is used. In the following, we explain the principles of the fast search method used in VMC.

Let $b_1$, $b_2$, and $b_3$ be the three pitch predictor taps and p be the pitch lag determined above. Then, the three-tap pitch predictor has a transfer function of $$P_1(z) = \sum_{i=1}^{3} b_i z^{-p+2-i}. \tag{16}$$

The energy of the open-loop pitch prediction residual is $$D = \sum_{k=1}^{48} \left[ d(k) - \sum_{i=1}^{3} b_i d(k-p+2-i) \right]^2 \tag{17}$$

-continued $$= E - 2\sum_{i=1}^{3} b_i\psi(2-p, i) + \sum_{i=1}^{3}\sum_{j=1}^{3} b_i b_j \psi(i, j), \quad (18)$$

where $$\psi(i, j) = \sum_{k=1}^{l} d(k-p+2-i)d(k-p+2-j), \quad (19)$$

and $$E = \sum_{k=1}^{L} d^2(k). \quad (20)$$

Note that D can be expressed as $$D = E - c^T y \quad (21)$$

where $$c^T = [\Psi(2-p,1), \Psi(2-p,2), \Psi(2-p,3), \Psi(1,2), \Psi(2,3), \Psi(3,1), \Psi(1,1), \Psi(2,2), \Psi(3,3)], \quad (22)$$

and $$y = [2b_1, 2b_2, 2b_3, -2b_1b_2, -2b_2b_3, -2b_3b_1, -b_1^2, -b_2^2, -b_3^2]^T \quad (23)$$

(the superscript T denotes transposition of a vector or a matrix). Therefore, minimizing D is equivalent to maximizing $c^T y$, the inner product of two 9-dimensional vectors. For each of the 64 candidate sets of pitch predictor taps in the 6-bit codebook, there is a corresponding 9-dimensional vector y associated with it. We can pre-compute and store the 64 possible 9-dimensional y vectors. Then, in the codebook search for the pitch predictor taps, the 9-dimensional vector c is first computed; then, the 64 inner products with the 64 stored y vectors are calculated, and the y vector with the largest inner product is identified. The three quantized predictor taps are then obtained by multiplying the first three elements of this y vector by 0.5. The 6-bit index of this codevector y is passed to the output bit-stream multiplexer once per sub-frame.

3.5 Perceptual Weighting Filter Coefficient Update Module

The perceptual weighting update block 5 in FIG. 2 calculates and updates the perceptual weighting filter coefficients once a sub-frame according to the next three equations:

$$W(z) = \frac{A(z/\gamma_1)}{A(z/\gamma_2)}, \; 0 < \gamma_2 < \gamma_1 \leqq 1, \quad (24)$$

$$A(z/\gamma_1) = \sum_{i=0}^{10} (a_i\gamma_1^i)\, z^{-i}, \quad (25)$$

and $$A(z/\gamma_2) = \sum_{i=0}^{10} (a_i\gamma_2^i)\, z^{-i}, \quad (26)$$

where $a_i$'s are the quantized and interpolated LPC predictor coefficients. The perceptual weighting filter is illustratively a 10-th order pole-zero filter defined by the transfer function W(z) in Eq. (24). The numerator and denominator polynomial coefficients are obtained by performing bandwidth expansion on the LPC predictor coefficients, as defined in Eqs. (25) and (26). Typical values of $\gamma_1$ and $\gamma_2$ are 0.9 and 0.4, respectively. The calculated coefficients are passed to three separate perceptual weighting filters (blocks 6, 10, and 24) and the impulse response vector calculator (block 12).

So far the frame-by-frame or subframe-by-subframe updates of the LPC predictor, the pitch predictor, and the perceptual weighting filter have all been described. The next step is to describe the vector-by-vector encoding of the twelve 4-dimensional excitation vectors within each sub-frame.

3.6 Perceptual Weighting Filters

There are three separate perceptual weighting filters in FIG. 2 (blocks 6, 10, and 24) with identical coefficients but different filter memory. We first describe block 6. In FIG. 2, the current input speech vector s(n) is passed through the perceptual weighting filter (block 6), resulting in the weighted speech vector v(n). Note that since the coefficients of the perceptual weighting filter are time-varying, the direct-form II digital filter structure is no longer equivalent to the direct-form I structure. Therefore, the input speech vector s(n) should first be filtered by the FIR section and then by the IIR section of the perceptual weighting filter. Also note that except during initialization (reset), the filter memory (i.e. internal state variables, or the values held in the delay units of the filter) of block 6 should not be reset to zero at any time. On the other hand, the memory of the other two perceptual weighting filters (blocks 10 and 24) requires special handling as described later.

3.7 Pitch Synthesis Filters

There are two pitch synthesis filters in FIG. 2 (block 8 and 22) with identical coefficients but different filter memory. They are variable-order, all-pole filters consisting of a feedback loop with a 3-tap pitch predictor in the feedback branch (see FIG. 1). The transfer function of the filter is $$F_1(z) = \frac{1}{1 - P_1(z)}. \quad (27)$$

where $P_1(z)$ is the transfer function of the 3-tap pitch predictor defined in Eq. (16) above. The filtering operation and the filter memory update require special handling as described later.

3.8 LPC Synthesis Filters

There are two LPC synthesis filters in FIG. 2 (blocks 9 and 23) with identical coefficients but different filter memory. They are 10-th order all-pole filters consisting of a feedback loop with a 10-th order LPC predictor in the feedback branch (see FIG. 1). The transfer function of the filter is $$F_2(z) = \frac{1}{1 - P_2(z)} = \frac{1}{A(z)}, \quad (28)$$

where $P_2(z)$ and A(z) are the transfer functions of the LPC predictor and the LPC inverse filter, respectively, as defined in Eqs. (10) and (11). The filtering operation and the filter memory update require special handling as described next.

3.9 Zero-Input Response Vector Computation

To perform a computationally efficient excitation VQ codebook search, it is necessary to decompose the output vector of the weighted synthesis filter (the cascade filter composed of the pitch synthesis filter, the LPC synthesis filter, and the perceptual weighting filter) into two components: the zero-input response (ZIR) vector and the zero-state response (ZSR) vector. The zero-input response vector is computed by the lower filter branch (blocks 8, 9, and 10) with a zero signal applied to the input of block 8 (but with non-zero filter memory). The zero-state response vector is computed by the upper filter branch (blocks 22, 23, and 24) with zero filter states (filter memory) and with the quantized and gain-scaled excitation vector applied to the input of block 22. The three filter memory control units between the two filter branches are there to reset the filter memory of the upper (ZSR) branch to zero, and to update the filter memory of the lower (ZIR) branch. The sum of the ZIR vector and the ZSR vector will be the same as the output vector of the upper filter branch if it did not have filter memory resets.

In the encoding process, the ZIR vector is first computed, the excitation VQ codebook search is next performed, and then the ZSR vector computation and filter memory updates are done. The natural approach is to explain these tasks in the same order. Therefore, we will only describe the ZIR vector computation in this section and postpone the description of the ZSR vector computation and filter memory update until later.

To compute the current ZIR vector r(n), we apply a zero input signal at node 7, and let the three filters in the ZIR branch (blocks 8, 9, and 10) ring for 4 samples (1 vector) with whatever filter memory was left after the memory update done for the previous vector. This means that we continue the filtering operation for 4 samples with a zero signal applied at node 7. The resulting output of block 10 is the desired ZIR vector r(n).

Note that the memory of the filters 9 and 10 is in general non-zero (except after initialization); therefore, the output vector r(n) is also non-zero in general, even though the filter input from node 7 is zero. In effect, this vector r(n) is the response of the three filters to previous gain-scaled excitation vectors e(n−1), e(n−2), . . . . This vector represents the unforced response associated with the filter memory up to time (n−1).

3.10 VQ Target Vector Computation 11

This block subtracts the zero-input response vector r(n) from the weighted speech vector v(n) to obtain the VQ codebook search target vector x(n).

3.11 Backward Vector Gain Adapter 20

The backward gain adapter block 20 updates the excitation gain $\sigma(n)$ for every vector time index n. The excitation gain $\sigma(n)$ is a scaling factor used to scale the selected excitation vector y(n). This block takes the selected excitation codebook index as its input, and produces an excitation gain $\sigma(n)$ as its output. This functional block seeks to predict the gain of e(n) based on the gain of e(n−1) by using adaptive first-order linear prediction in the logarithmic gain domain. (Here, the gain of a vector is defined as the root-mean-square (RMS) value of the vector, and the log-gain is the dB level of the RMS value.) This backward vector gain adapter 20 is shown in more detail in FIG. 6.

Figure 6:
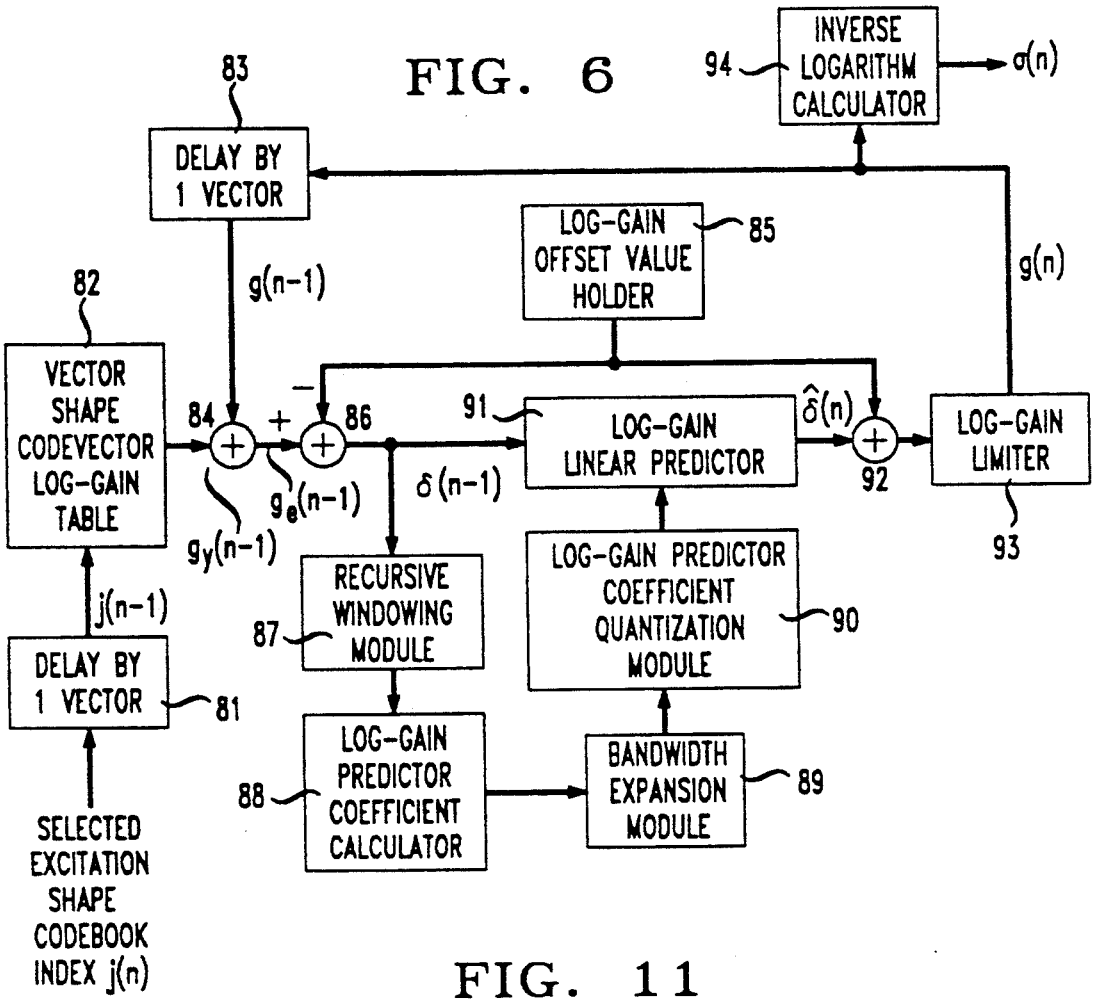
FIG. 6 shows an illustrative backward gain adaptor for use in the typical embodiment of FIG. 1.

Refer to FIG. 6. Let j(n) denote the winning 5-bit excitation shape codebook index selected for time n. Then, the 1-vector delay unit 81 makes available j(n−1), the index of the previous excitation vector y(n−1). With this index j(n−1), the excitation shape codevector log-gain table (block 82) performs a table look-up to retrieve the dB value of the RMS value of y(n−1). This table is conveniently obtained by first calculating the RMS value of each of the 32 shape codevectors, then taking base 10 logarithm and multiplying the result by 20.

Let $\sigma_e(n-1)$ and $\sigma_y(n-1)$ be the RMS values of e(n−1) and y(n−1), respectively. Also, let their corresponding dB values be $$g_e(n-1)=20\log_{10}\sigma_e(n-1), \tag{29}$$

and $$g_y(n-1)=20\log_{10}\sigma_y(n-1). \tag{30}$$

In addition, define $$g(n-1)=20\log_{10}\sigma(n-1). \tag{31}$$

By definition, the gain-scaled excitation vector e(n−1) is given by $$e(n-1)=\sigma(n-1)y(n-1) \tag{32}$$

Therefore, we have $$\sigma_e(n-1)=\sigma(n-1)\sigma_y(n-1), \tag{33}$$

or $$g_e(n-1)=g(n-1)+g_y(n-1). \tag{34}$$

Hence, the RMS dB value (or log-gain) of e(n−1) is the sum of the previous log-gain g(n−1) and the log-gain $g_y(n-1)$ of the previous excitation codevector y(n−1).

The shape codevector log-gain table 82 generates $g_y(n-1)$, and the 1-vector delay unit 83 makes the previous log-gain g(n−1) available. The adder 84 then adds the two terms together to get $g_e(n-1)$, the log-gain of the previous gain-scaled excitation vector e(n−1).

In FIG. 6, a log-gain offset value of 32 dB is stored in the log-gain offset value holder 85. (This value is meant to be roughly equal to the average excitation gain level, in dB, during voiced speech assuming the input speech was μ-law encoded and has a level of −22 dB below saturation.) The adder 86 subtracts this 32 dB log-gain offset value from $g_e(n-1)$. The resulting offset-removed log-gain δ(n−1) is then passed to the log-gain linear predictor 91; it is also passed to the recursive windowing module 87 to update the coefficient of the log-gain linear predictor 91.

The recursive windowing module 87 operates sample-by-sample. It feeds δ(n−1) through a series of delay units and computes the product δ(n−1)δ(n−1−i) for i=0, 1. The resulting product terms are then fed to two fixed-coefficient filters (one filter for each term), and the output of the i-th filter is the i-th autocorrelation coefficient $R_g(i)$. We call these two fixed filters recursive autocorrelation filters, since they recursively compute autocorrelation coefficients as their outputs.

Each of these two recursive autocorrelation filters consists of three first-order filters in cascade. The first two stages are identical all-pole filters with a transfer function of $1/[1-\alpha^2z^{-1}]$, where $\alpha=0.94$, and the third stage is a pole-zero filter with a transfer function of $[B(0,i)+B(1,i)z^{-1}]/[1-\alpha^2z^{-1}]$, where $B(0,i)=(i+1)\alpha^i$, and $B(1,i)=-(i-1)\alpha^{i+2}$.

Let $M_{ij}(k)$ be the filter state variable (the memory) of the j-th first-order section of the i-th recursive autocorrelation filter at time k. Also, let $a_r=\alpha^2$ be the coefficient of the all-pole sections. All state variables of the two recursive autocorrelation filters are initialized to zero at coder start-up (reset). The recursive windowing module computes the i-th autocorrelation coefficient R(i) according to the following recursion:

$$M_{i1}(k)=\delta(k)\delta(k-i)+a_rM_{i1}(k-1) \quad (35a)$$

$$M_{i2}(k)=M_{i1}(k)+a_rM_{i2}(k-1) \quad (35b)$$

$$M_{i3}(k)=M_{i2}(k)+a_rM_{i3}(k-1) \quad (35c)$$

$$R_g(i)=B(0,i)M_{i3}(k)+B(1,i)M_{i3}(k-1) \quad (35d)$$

We update the gain predictor coefficient once a sub-frame, except for the first sub-frame following initialization. For the first sub-frame, we use the initial value (1) of the predictor coefficient. Since each sub-frame contains 12 vectors, we can save computation by not doing the two multiply-adds associated with the all-zero portion of the two filters except when processing the first value in a sub-frame (when the autocorrelation coefficients are needed). In other words, Eq. (35d) is evaluated once for every twelve speech vectors. However, we do have to update the filter memory of the three all-pole sections for each speech vector using Eqs. (35a) through (35c).

Once the two autocorrelation coefficients $R_g(i)$, i=0, 1 are computed, we then calculate and quantize the first-order log-gain predictor coefficient using blocks 88, 89, and 90 in FIG. 6. Note that in a real-time implementation of the VMC coder, the three blocks 88, 89, and 90 are performed in one single operation as described later. These three blocks are shown separately in FIG. 6 and discussed separately below for ease of understanding.

Before calculating the log-gain predictor coefficient, the log-gain predictor coefficient calculator (block 88) first applies a white noise correction factor (WNCF) of (1+1/256) to $R_g(0)$. That is, $$\hat{R}_g(0) = \left(1 + \frac{1}{256}\right)R_g(0) = \frac{257}{256}R_g(0) \quad (36)$$

Note that even floating-point implementations have to use this white noise correction factor of 257/256 to ensure inter-operability. The first-order log-gain predictor coefficient is then calculated as $$\hat{\alpha}_1 = \frac{R_g(1)}{R_g(0)} \quad (37)$$

Next, the bandwidth expansion module 89 evaluates $$\hat{\alpha}_1=(0.9)\hat{\alpha}_1. \quad (38)$$

Bandwidth expansion is an important step for the gain adapter (block 20 in FIG. 2) to enhance coder robustness to channel errors. It should be recognized that multiplier value 0.9 is merely illustrative. Other values have proven useful in particular implementations.

The log-gain predictor coefficient quantization module 90 then quantizes $\hat{\alpha}_1$ typically using a log-gain predictor quantizer output level table in standard fashion. The quantization is not primarily for encoding and transmission, but rather to reduce the likelihood of gain predictor mistracking between encoder and decoder and to simplify DSP implementations.

With the functional operation of blocks 88, 89 and 90 introduced, we now describe the implementation procedures for implementing these blocks in one operation. Note that since division takes many more instruction cycles to implement than multiplication in a typical DSP, the division specified in Eq. (37) is best avoided. This can be done by combining Eqs. (36) through (38) to get $$\hat{\alpha}_1 = 0.9\left(\frac{256}{257}\right)\frac{R_g(1)}{R_g(0)} \approx \frac{R_g(1)}{1.115\,R_g(0)} \quad (39)$$

Let $B_i$ be the i-th quantizer cell boundary (or decision threshold) of the log-gain predictor coefficient quantizer. The quantization of $\hat{\alpha}_1$ is normally done by comparing $\hat{\alpha}_1$ with $B_i$'s to determine which quantizer cell $\hat{\alpha}_1$ is in. However, comparing $\hat{\alpha}_1$ with $B_i$ is equivalent to directly comparing $R_g(1)$ with $1.115\,B_i\,R_g(0)$. Therefore, we can perform the function of blocks 88, 89, and 90 in one operation, and the division operation in Eq. (37) is avoided. With this approach, efficiency is best served by storing $1.115\,B_i$ rather than $B_i$ as the (scaled) coefficient quantizer cell boundary table.

The quantized version of $\hat{\alpha}_1$, denoted as $\alpha_1$, is used to update the coefficient of the log-gain linear predictor 91 once each sub-frame, and this coefficient update takes place on the first speech vector of every sub-frame. Note that the update is inhibited for the first sub-frame after coder initialization (reset). The first-order log-gain linear predictor 91 attempts to predict δ(n) based on δ(n−1). The predicted version of $\hat{\delta}(n)$, denoted as δ(n), is given by $$\hat{\delta}(n)=\alpha_1\delta(n-1) \quad (40)$$

After $\hat{\delta}(n)$ has been produced by the log-gain linear predictor 91, we add back the log-gain offset value of 32 dB stored in block 85. The log-gain limiter 93 then checks the resulting log-gain value and clips it if the value is unreasonably large or small. The lower and upper limits for clipping are set to 0 dB and 60 dB, respectively. The gain limiter ensures that the gain in the linear domain is between 1 and 1000.

The log-gain limiter output is the current log-gain g(n). This log-gain value is fed to the delay unit 83. The inverse logarithm calculator 94 then converts the log-gain g(n) back to the linear gain σ(n) using the equation:

$$\sigma(n) = 10^{\frac{g(n)}{20}}.$$

This linear gain σ(n) is the output of the backward vector gain adapter (block 20 in FIG. 2).

3.12 Excitation Codebook Search Module

In FIG. 2, blocks 12 through 18 collectively form an illustrative codebook search module 100. This module searches through the 64 candidate codevectors in the excitation VQ codebook (block 19) and identifies the index of the codevector that produces a quantized speech vector closest to the input speech vector with respect to an illustrative perceptually weighted mean-squared error metric.

The excitation codebook contains 64 4-dimensional codevectors. The 6 codebook index bits consist of 1 sign bit and 5 shape bits. In other words, there is a 5-bit shape codebook that contains 32 linearly independent shape codevectors, and a sign multiplier of either +1 or −1, depending on whether the sign bit is 0 or 1. This sign bit effectively doubles the codebook size without doubling the codebook search complexity. It makes the 6-bit codebook symmetric about the origin of the 4-dimensional vector space. Therefore, each codevector in the 6-bit excitation codebook has a mirror image about the origin that is also a codevector in the codebook. The 5-bit shape codebook is advantageously a trained codebook, e.g., using recorded speech material in the training process.

Before describing the illustrative codebook search procedure in detail, we first briefly review the broader aspects of an advantageous codebook search technique.

3.12.1 Excitation Codebook Search Overview

In principle, the illustrative codebook search module scales each of the 64 candidate codevectors by the current excitation gain $\sigma(n)$ and then passes the resulting 64 vectors one at a time through a cascade filter consisting of the pitch synthesis filter $F_1(z)$, the LPC synthesis filter $F_2(z)$, and the perceptual weighting filter $W(z)$. The filter memory is initialized to zero each time the module feeds a new codevector to the cascade filter (transfer function $H(z)=F_1(z)F_2(z)W(z)$).

This type of zero-state filtering of VQ codevectors can be expressed in terms of matrix-vector multiplication. Let $y_j$ be the j-th codevector in the 5-bit shape codebook, and let $g_i$ be the i-th sign multiplier in the 1-bit sign multiplier codebook ($g_0=+1$ and $g_1=-1$). Let $\{h(k)\}$ denote the impulse response sequence of the cascade filter $H(z)$. Then, when the codevector specified by the codebook indices i and j is fed to the cascade filter $H(z)$, the filter output can be expressed as $$\tilde{x}_{ij}=H\sigma(n)g_iy_j, \tag{41}$$

where $$H=\begin{bmatrix} h(0) & 0 & 0 & 0 \\ h(1) & h(0) & 0 & 0 \\ h(2) & h(1) & h(0) & 0 \\ h(3) & h(2) & h(1) & h(0) \end{bmatrix}. \tag{42}$$

The codebook search module searches for the best combination of indices i and j which minimizes the following Mean-Squared Error (MSE) distortion $$D=\|x(n)-\tilde{x}_{ij}\|^2\sigma^2(n)\|\tilde{x}(n)-g_iHy_j\|^2, \tag{43}$$

where $\tilde{x}(n)=x(n)/\sigma(n)$ is the gain-normalized VQ target vector, and the notation $\|x\|$ means the Euclidean norm of the vector x. Expanding the terms gives $$D=\sigma^2(n)[\|\tilde{x}(n)\|^2-2g\tilde{x}^T(n)Hy_j+g_i^2\|Hy_j\|^2]. \tag{44}$$

Since $g_i^2=1$ and the values of $\|\tilde{x}(n)\|^2$ and $\sigma^2(n)$ are fixed during the codebook search, minimizing D is equivalent to minimizing $$\tilde{D}=-gp^T(n)y_j+E_j, \tag{45}$$

where $$p(n)=2H^T\tilde{x}(n), \tag{46}$$

and $$E_j=\|Hy_j\|^2. \tag{47}$$

Note that $E_j$ is actually the energy of the j-th filtered shape codevectors and does not depend on the VQ target vector $\tilde{x}(n)$. Also note that the shape codevector $y_j$ is fixed, and the matrix H only depends on the cascade filter $H(z)$, which is fixed over each sub-frame. Consequently, Ej is also fixed over each sub-frame. Based on this observation, when the filters are updated at the beginning of each sub-frame, we can compute and store the 32 energy terms $E_j$, $j=0, 1, 2, \ldots, 31$, corresponding to the 32 shape codevectors, and then use these energy terms in the codebook search for the 12 excitation vectors within the sub-frame. The precomputation of the energy terms, $E_j$, reduces the complexity of the code book search.

Note that for a given shape codebook index j, the distortion term defined in Eq. (45) will be minimized if the sign multiplier term $g_i$ is chosen to have the same sign as the inner product term $p^T(n)y_j$. Therefore, the best sign bit for each shape codevector is determined by the sign of the inner product $p^T(n)y_j$. Hence, in the codebook search we evaluate Eq. (45) for $j=0, 1, 2, \ldots, 31$, and pick the shape index j(n) and the corresponding sign index i(n) that minimizes $\hat{D}$. Once the best indices i and j are identified, they are concatenated to form the output of the codebook search module—a single 6-bit excitation codebook index.

3.12.2 Operation of the Excitation Codebook Search Module

With the illustrative codebook search principles introduced, the operation of the codebook search module 100 is now described below. Refer to FIG. 2. Every time the coefficients of the LPC synthesis filter and the perceptual weighting filter are updated at the beginning of each sub-frame, the impulse response vector calculator 12 computes the first 4 samples of the impulse response of the cascade filter $F_2(z)W(z)$. (Note that $F_1(z)$ is omitted here, since the pitch lag of the pitch synthesis filter is at least 20 samples, and so $F_1(z)$ cannot influence the impulse response of $H(z)$ before the 20-th sample.) To compute the impulse response vector, we first set the memory of the cascade filter $F_2(z)W(z)$ to zero, and then excite the filter with an input sequence $\{1, 0, 0, 0\}$. The corresponding 4 output samples of the filter are $h(0), h(1), \ldots, h(3)$, which constitute the desired impulse response vector. The impulse response vector is computed once per sub-frame.

Next, the shape codevector convolution module 13 computes the 32 vectors $Hy_j$, $j=0, 1, 2, \ldots, 31$. In other words, it convolves each shape codevector $y_j$, $j=0, 1, 2, \ldots, 31$ with the impulse response sequence $h(0), h(1), \ldots, h(3)$, where the convolution is only performed for the first 4 samples. The energy of the resulting 32 vectors are then computed and stored by the energy table calculator 14 according to Eq. (47). The energy of a vector is defined as the sum of the squares of the vector components.

Note that the computations in blocks 12, 13, and 14 are performed only once a sub-frame, while the other blocks in the codebook search module 100 perform computations for each 4-dimensional speech vector.

The VQ target vector normalization module 15 calculates the gain-normalized VQ target vector $\hat{x}(n)=x(n)/\sigma(n)$. In DSP implementations, it is more efficient to first compute $1/\sigma(n)$, and then multiply each component of $x(n)$ by $1/\sigma(n)$.

Next, the time-reversed convolution module 16 computes the vector $p(n)=2H^T\hat{x}(n)$. This operation is equivalent to first reversing the order of the components of $\hat{x}(n)$, then convolving the resulting vector with the impulse response vector, and then reverse the component order of the output again (hence the name time-reversed convolution).

Once the $E_j$ table is precomputed and stored, and the vector p(n) is calculated, then the error calculator 17 and the best codebook index selector 18 work together to perform the following efficient codebook search algorithm.

1. Initialize $\hat{D}_{min}$ to the largest number representable by the target machine implementing the VMC.
2. Set the shape codebook index j=0.
3. Compute the inner product $P_j=p^T(n)y_j$.
4. If $P_j<0$, go to step 6; otherwise, compute $\hat{D}=-P_j+E_j$ and proceed to step 5.
5. If $\hat{D}\geqq\hat{D}_{min}$, go to step 8; otherwise, set $\hat{D}_{min}=\hat{D}$, i(n)=0, and j(n)=j.
6. Compute $\hat{D}=P_j+E_j$ and proceed to step 7.
7. If $\hat{D}\geqq\hat{D}_{min}$, go to step 8; otherwise, set $\hat{D}_{min}=\hat{D}$, i(n)=1, and j(n)=j.
8. If j<31, set j=j+1 and go to step 3; otherwise proceed to step 9.
9. Concatenate the optimal shape index, i(n), and the optimal gain index, j(n), and pass to the output bit-stream multiplexer.

3.13 Zero-State Response Vector Calculation and Filter Memory Updates

After the excitation codebook search is done for the current vector, the selected codevector is used to obtain the zero-state response vector, that in turn is used to update the filter memory in blocks 8, 9, and 10 in FIG. 2.

First, the best excitation code book index is fed to the excitation VQ codebook (block 19) to extract the corresponding quantized excitation codevector $$y(n)=g_{i(n)}y_{j(n)}. \tag{48}$$

The gain scaling unit (block 21) then scales this quantized excitation codevector by the current excitation gain $\sigma(n)$. The resulting quantized and gain-scaled excitation vector is computed as $e(n)=\sigma(n)y(n)$ (Eq. (32)).

To compute the ZSR vector, the three filter memory control units (blocks 25, 26, and 27) first reset the filter memory in blocks 22, 23, and 24 to zero. Then, the cascade filter (blocks 22, 23, and 24) is used to filter the quantized and gain-scaled excitation vector e(n). Note that since e(n) is only 4 samples long and the filters have zero memory, the filtering operation of block 22 only involves shifting the elements of e(n) into its filter memory. Furthermore, the number of multiply-adds for filters 23 and 24 each goes from 0 to 3 for the 4-sample period. This is significantly less than the complexity of 30 multiply-adds per sample that would be required if the filter memory were not zero.

The filtering of e(n) by filters 22, 23, and 24 will establish 4 non-zero elements at the top of the filter memory of each of the three filters. Next, the filter memory control unit 1 (blocks 25) takes the top 4 non-zero filter memory elements of block 22 and adds them one-by-one to the corresponding top 4 filter memory elements of block 8. (At this point, the filter memory of blocks 8, 9, and 10 is what's left over after the filtering operation performed earlier to generate the ZIR vector r(n).) Similarly, the filter memory control unit 2 (blocks 26) takes the top 4 non-zero filter memory elements of block 23 and adds them to the corresponding filter memory elements of block 9, and the filter memory control unit 3 (blocks 27) takes the top 4 non-zero filter memory elements of block 24 and adds them to the corresponding filter memory elements of block 10. This in effect adds the zero-state responses to the zero-input responses of the filters 8, 9, and 10 and completes the filter memory update operation. The resulting filter memory in filters 8, 9, and 10 will be used to compute the zero-input response vector during the encoding of the next speech vector.

Note that after the filter memory update, the top 4 elements of the memory of the LPC synthesis filter (block 9) are exactly the same as the components of the decoder output (quantized) speech vector $s_q(n)$. Therefore, in the encoder, we can obtain the quantized speech as a by-product of the filter memory update operation.

This completes the last step in the vector-by-vector encoding process. The encoder will then take the next speech vector s(n+1) from the frame buffer and encode it in the same way. This vector-by-vector encoding process is repeated until all the 48 speech vectors within the current frame are encoded. The encoder then repeats the entire frame-by-frame encoding process for the subsequent frames.

3.14 Output Bit-Stream Multiplexer

For each 192-sample frame, the output bit stream multiplexer block 28 multiplexes the 44 reflection coefficient encoded bits, the 13×4 pitch predictor encoded bits, and the 4×48 excitation encoded bits into a special frame format, as described more completely in Section 5.

4. VMC Decoder Operation

Figure 3:
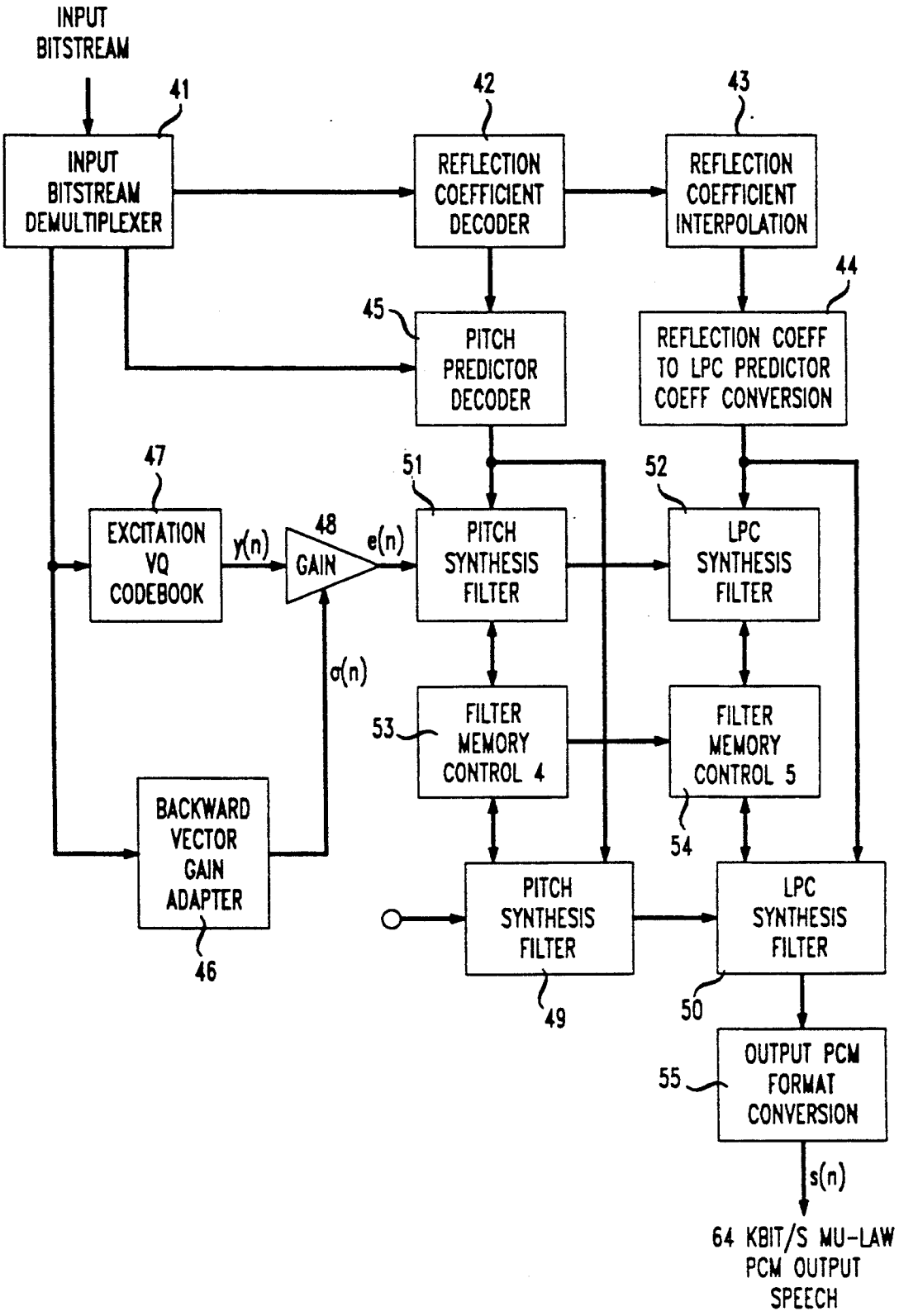
FIG. 3 is a more detailed block diagram of a decoder of the type shown in FIG. 2.

FIG. 3 is a detailed block schematic of the VMC decoder. A functional description of each block is given in the following sections.

4.1 Input Bit-Stream Demultiplexer 41

This block buffers the input bit-stream appearing on input 40 finds the bit frame boundaries, and demultiplexes the three kinds of encoded data: reflection coefficients, pitch predictor parameters, and excitation vectors according to the bit frame format described in Section 5.

4,2 Reflection Coefficient Decoder 42

This block takes the 44 reflection coefficient encoded bits from the input bit-stream demultiplexer, separates them into 10 groups of bits for the 10 reflection coefficients, and then performs table look-up using the reflection coefficient quantizer output level tables of the type illustrated in Appendix A to obtain the quantized reflection coefficients.

4.3 Reflection Coefficient Interpolation Module 43

This block is described in Section 3.3 (see Eq. (7)).

4.4 Reflection Coefficient to LPC Predictor Coefficient Conversion Module 44

The function of this block is described in Section 3.3 (see Eqs. (8) and (9)). The resulting LPC predictor coefficients are passed to the two LPC synthesis filters (blocks 50 and 52) to update their coefficients once a sub-frame.

4.5 Pitch Predictor Decoder 45

This block takes the 4 sets of 13 pitch predictor encoded bits (for the 4 sub-frames of each frame) from the input bit-stream demultiplexer. It then separates the 7 pitch lag encoded bits and 6 pitch predictor tap encoded bits for each sub-frame, and calculates the pitch lag and decodes the 3 pitch predictor taps for each sub-frame. The 3 pitch predictor taps are decoded by using the 6 pitch predictor tap encoded bits as the address to extract the first three components of the corresponding 9-dimensional codevector at that address in a pitch predictor tap VQ codebook table, and then, in a particular embodiment, multiplying these three components by 0.5. The decoded pitch lag and pitch predictor taps are passed to the two pitch synthesis filters (blocks 49 and 51).

4.6 Backward Vector Gain Adapter 46

This block is described in Section 3.11.

4.7 Excitation VQ Codebook 47

This block contains an excitation VQ codebook (including shape and sign multiplier codebooks) identical to the codebook 19 in the VMC encoder. For each of the 48 vectors in the current frame, this block obtains the corresponding 6-bit excitation codebook index from the input bit-stream demultiplexer 41, and uses this 6-bit index to perform a table look-up to extract the same excitation codevector y(n) selected in the VMC encoder.

4.8 Gain Scaling Unit 48

The function of this block is the same as the block 21 described in Section 3.13. This block computes the gain-scaled excitation vector as $e(n)=\sigma(n)y(n)$.

4.9 Pitch and LPC Synthesis Filters

The pitch synthesis filters 49 and 51 and the LPC synthesis filters 50 and 52 have the same transfer functions as their counterparts in the VMC encoder (assuming error-free transmission). They filter the scaled excitation vector e(n) to produce the decoded speech vector $s_d(n)$. Note that if numerical round-off errors were not of concern, theoretically we could produce the decoded speech vector by passing e(n) through a simple cascade filter comprised of the pitch synthesis filter and LPC synthesis filter. However, in the VMC encoder the filtering operation of the pitch and LPC synthesis filters is advantageously carried out by adding the zero-state response vectors to the zero-input response vectors. Performing the decoder filtering operation in a mathematically equivalent, but arithmetically different way may result in perturbations of the decoded speech because of finite precision effects. To avoid any possible accumulation of round-off errors during decoding, it is strongly recommended that the decoder exactly duplicate the procedures used in the encoder to obtain $s_q(n)$. In other words, the decoder should also compute $s_d(n)$ as the sum of the zero-input response and the zero-state response, as was done in the encoder.

This is shown in the decoder of FIG. 3, where blocks 49 through 54 advantageously exactly duplicate blocks 8, 9, 22, 23, 25, and 26 in the encoder. The function of these blocks has been described in Section 3.

4.10 Output PCM Format Conversion

This block converts the 4 components of the decoded speech vector $s_d(n)$ into 4 corresponding $\mu$-law PCM samples and output these 4 PCM samples sequentially at 125 $\mu$s time intervals. This completes the decoding process.

5. Compressed Data Format 5.1 Frame Structure

VMC is a block coder that illustratively compresses 192 $\mu$-law samples (192 bytes) into a frame (48 bytes) of compressed data. For each block of 192 input samples, the VMC encoder generates 12 bytes of side information and 36 bytes of excitation information. In this section, we will describe how the side and excitation information are assembled to create an illustrative compressed data frame.

The side information controls the parameters of the long- and short-term prediction filters. In VMC, the long-term predictor is updated four times per block (every 48 samples) and the short-term predictor is updated once per block (every 192 samples). The parameters of the long-term predictor consist of a pitch lag (period) and a set of three filter coefficients (tap weights). The filter taps are encoded as a vector. The VMC encoder constrains the pitch lag to be an integer between 20 and 120. For storage in a compressed data frame, the pitch lag is mapped into an unsigned 7-bit binary integer. The constraints on the pitch lag imposed by VMC imply that encoded lags from 0×0 to 0×13 (0 to 19) and from 0×79 to 0×7f (121 to 127) are not admissible. VMC allocates 6 bits for specifying the pitch filter for each 48 sample sub-frame, and so there are a total of $2^6=64$ entries in the pitch filter VQ codebook. The pitch filter coefficients are encoded as a 6-bit unsigned binary number equivalent to the index of the selected filter in the codebook. For the purpose of this discussion, the pitch lags computed for the four sub-frames will be denoted by $P_L[0],P_L[1],\ldots,P_L[3]$, and the pitch filter indices will be denoted by $P_F[0],P_F[1],\ldots,P_F[3]$.

Side information produced by the short-term predictor consists of 10 quantized reflection coefficients. Each of the coefficients is quantized with a unique non-uniform scalar code book optimized for that coefficient. The short-term predictor side information is encoded by mapping the output levels of each of the 10 scalar codebooks into an unsigned binary integer. For a scalar codebook allocated B bits, the codebook entries are ordered from smallest to largest and an unsigned binary integer is associated with each as a codebook index. Hence, the integer 0 is mapped into the smallest quantizer level and the integer $2^B-1$ is mapped into the largest quantizer level. In the discussion that follows, the 10 encoded reflection coefficients will be denoted by rc[1],rc[2], . . . ,rc[10]. The number of bits allocated for the quantization of each reflection coefficient are listed in Table 1.

TABLE 1

Contents of the Side Information Component of a VMC Frame.

| Quantity | Symbol | Bits |
|---|---|---|
| Pitch Filter for Sub-frame 0 | $P_F[0]$ | 6 |
| Pitch Filter for Sub-frame 1 | $P_F[1]$ | 6 |
| Pitch Filter for Sub-frame 2 | $P_F[2]$ | 6 |
| Pitch Filter for Sub-frame 3 | $P_F[3]$ | 6 |
| Pitch Lag for Sub-frame 0 | $P_L[0]$ | 7 |
| Pitch Lag for Sub-frame 1 | $P_L[1]$ | 7 |
| Pitch Lag for Sub-frame 2 | $P_L[2]$ | 7 |
| Pitch Lag for Sub-frame 3 | $P_L[3]$ | 7 |
| Reflection Coefficient 1 | rc[1] | 6 |
| Reflection Coefficient 2 | rc[2] | 6 |
| Reflection Coefficient 3 | rc[3] | 5 |
| Reflection Coefficient 4 | rc[4] | 5 |
| Reflection Coefficient 5 | rc[5] | 4 |
| Reflection Coefficient 6 | rc[6] | 4 |
| Reflection Coefficient 7 | rc[7] | 4 |
| Reflection Coefficient 8 | rc[8] | 4 |
| Reflection Coefficient 9 | rc[9] | 3 |
| Reflection Coefficient 10 | rc[10] | 3 |

Figure 7:
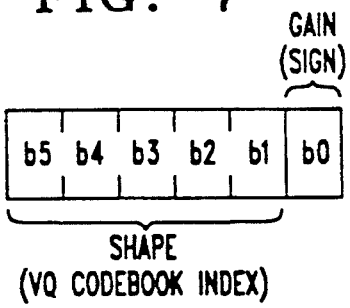
FIG. 7 shows a typical format for encoded excitation information (gain and shape) used in the embodiment of FIG. 1.

Each illustrative VMC frame contains 36 bytes of excitation information that define 48 excitation vectors. The excitation vectors are applied to the inverse long- and short-term predictor filters to reconstruct the voice message. 6 bits are allocated to each excitation vector: 5 bits for the shape and 1 bit for the gain. The shape component is an unsigned integer with range 0 to 31 that indexes a shape codebook with 32 entries. Since a single bit is allocated for gain, the gain component simply specifies the algebraic sign of the excitation vector. A binary 0 denotes a positive algebraic sign and a binary 1 a negative algebraic sign. Each excitation vector is specified by a 6 bit unsigned binary number. The gain bit occupies the least significant bit location (see FIG. 7).

Figure 8:
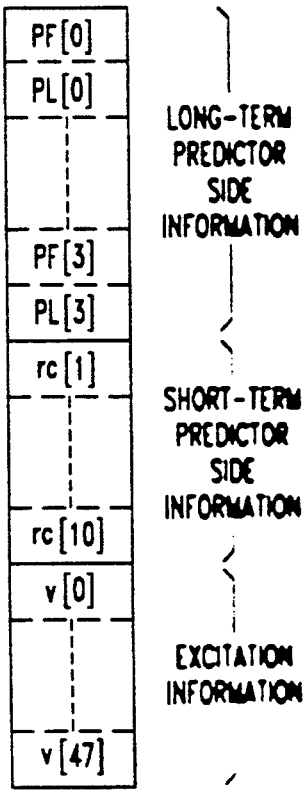
FIG. 8 illustrates a typical packing order for a compressed data frame used in coding and decoding in the illustrative system of FIG. 1.

Let the sequence of excitation vectors in a frame be denoted by v[0],v[1], . . . ,v[47]. The binary data generated by the VMC encoder are packed into a sequence of bytes for transmission or storage in the order shown in FIG. 8. The encoded binary quantities are packed least significant bit first.

Figure 9:
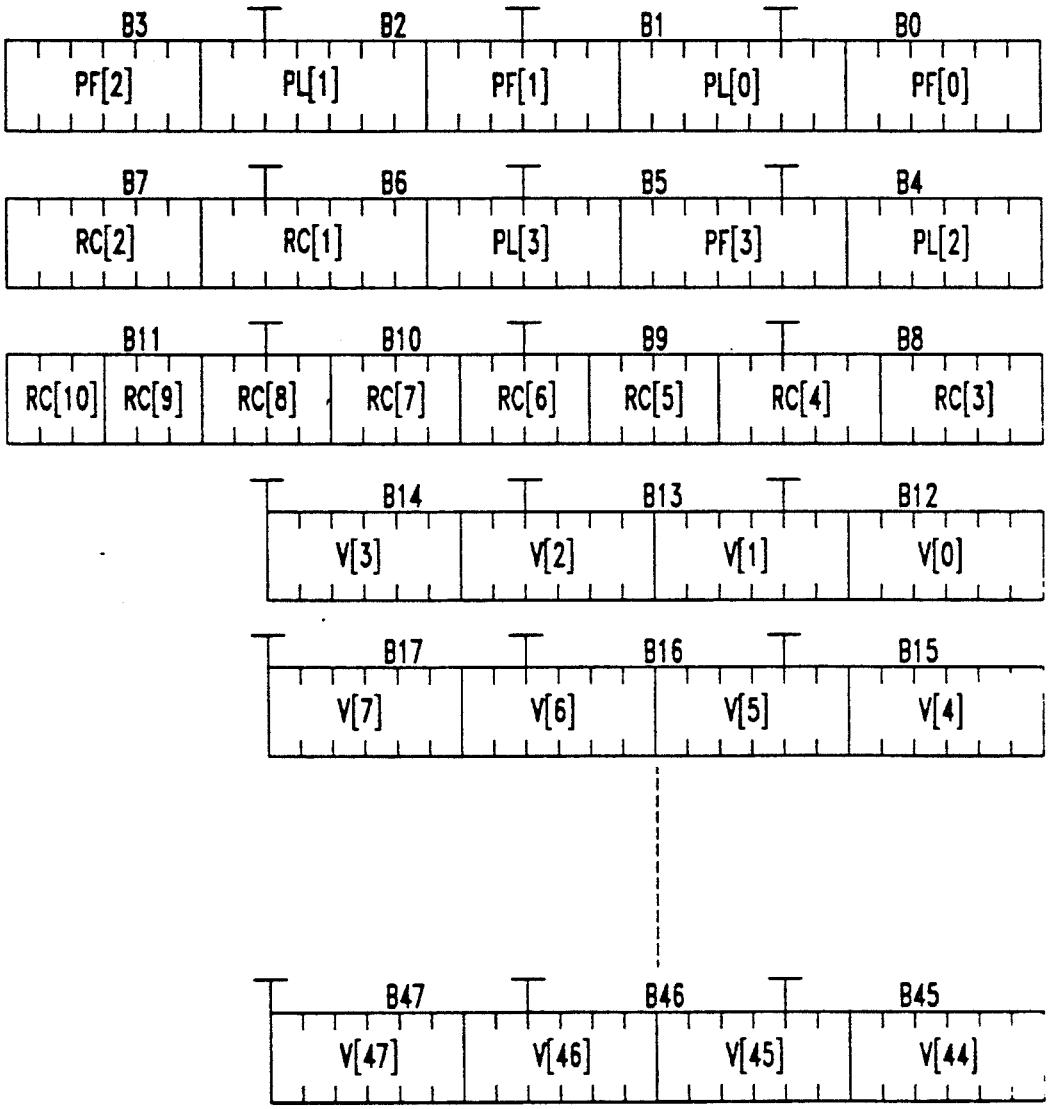
FIG. 9 illustrates one data frame (48 bytes) illustratively used in the system of FIG: 1.

A VMC encoded data frame is shown in FIG. 9 with the 48 bytes of binary data arranged into a sequence of three 4-byte words followed by twelve 3-byte words. The side information occupies the leading three 4-byte words (the preamble) and the excitation information occupies the remaining twelve 3-byte words (the body). Note that the each of the encoded side information quantities are contained in a single 4-byte word within the preamble (i.e., no bit fields wrap around from one word to the next). Furthermore, each of the 3-byte words in the body of the frame contain three encoded excitation vectors.

Frame boundaries are delineated with synchronization headers. One extant standard message format specifies a synchronization header of the form: 0×AA 0×FF N L where N denotes an 8-bit tag (two hex characters) that uniquely identifies the data format and L (also an 8-bit quantity) is the length of the control field following the header.

An encoded data frame for the illustrative VMC coder contains a mixture of excitation and side information, and the successful decoding of a frame is dependent on the correct interpretation of the data contained therein. In the decoder, mistracking of frame boundaries will adversely affect any measure of speech quality and may render a message unintelligible. Hence, a primary objective for the synchronization protocol for use in systems embodying the present invention is to provide unambiguous identification of frame boundaries. Other objectives considered in the design are listed below:

1) Maintain compatibility with existing standard.
2) Minimize the overhead consumed by synchronization headers.
3) Minimize the maximum time required for synchronization for a decoder starting at some random point in an encoded voice message.
4) Minimize the probability of mistracking during decoding, assuming high storage media reliability and whatever error correction techniques are used in storage and transmission.
5) Minimize the complexity of the synchronization protocol to avoid burdening the encoder or decoder with unnecessary processing tasks.

Compatibility with the extant standards is important for inter-operability in applications such as voice mail networking. Such compatibility (for at least one widely used application) implies that overhead information (synchronization headers) will be injected into the stream of encoded data and that the headers will have the form:

0×AA 0×FF N L where N is a unique code identifying the encoding format and L is the length (in 2-byte words) of an optional control field.

Insertion of one header encumbers an overhead of 4 bytes. If a header is inserted at the beginning of each VMC frame, the overhead increases the compressed data rate by 2.2 kB/s. The overhead rate can be minimized by inserting headers less often than every frame, but increasing the number of frames between headers will increase the time interval required for synchronization from a random point in a compressed voice message. Hence, a balance must be achieved between the need to minimize overhead and synchronization delay. Similarly, a balance must be struck between objectives (4) and (5). If headers are prohibited from occurring within a VMC frame, then the probability of mis-identification of a frame boundary is zero (for a voice message with no bit errors). However, the prohibition of headers within a data frame requires enforcement which is not always possible. Bit-manipulation strategies (e.g., bit-stuffing) consume significant processing resources and violate byte-boundaries creating difficulties in storing messages on disk without trailing orphan bits. Data manipulation strategies used in some systems alter encoded datum to preclude the random occurrence of headers. Such preclusion strategies prove unattractive in the VMC. The effects of perturbations in the various classes of encoded data (side versus excitation information, etc.) would have to be evaluated under a variety of conditions. Furthermore, unlike SBC in which adjacent binary patterns correspond to nearest-neighbor subband excitation, no such property is exhibited by the excitation or pitch codebooks in the VMC coder. Thus it is not clear how to perturb a compressed datum to minimize the effect on the reconstructed speech waveform.

With the objectives and considerations discussed above, the following synchronization header structure was selected for VMC:

1) The synchronization header is 0×AA 0×FF 0×40 {0×00,0×01}.
2) The header 0×AA 0×FF 0×40 0×01 is followed by a control field 2-bytes in length. A value of 0×00 0×01 in the control field specifies a reset of the coder state. Other values of the control field are reserved for other particular control functions, as will occur to those skilled in the art.
3) A reset header 0×AA 0×FF 0×40 0×01 followed by the control word 0×00 0×01 must precede a compressed message produced by an encoder starting from its initial (or reset) state.
4) Subsequent headers of the form 0×AA 0×FF 0×40 0×00 must be injected between VMC frames no less often than at the end of every fourth frame.
5) Multiple headers may be injected between VMC frames without limit, but no header may be injected within a VMC frame.
6) No bit manipulations or data perturbations are performed to preclude the occurrence of a header within a VMC frame.

Despite the lack of a prohibition of headers occurring within a VMC frame, it is essential that the header patterns (0×AA 0×FF 0×40 0×00 and 0×AA 0×FF 0×40 0×01) can be distinguished from the beginning (first four bytes) of any admissible VMC frame. This is particularly important since the protocol only specifies the maximum interval between headers and does not prohibit multiple headers from appearing between adjacent VMC frames. The accommodation of ambiguity in the density of headers is important in the voice mail industry where voice messages may be edited before transmission or storage. In a typical scenario, a subscriber may record a message, then rewind the message for editing and re-record over the original message beginning at some random point within the message. A strict specification on the injection of headers within the message would either require a single header before every frame resulting in a significant overhead load or strict junctures on where editing may and may not begin resulting in needless additional complexity for the encoder/decoder or post processing of a file to adjust the header density. The frame preamble makes use of the nominal redundancy in the pitch lag information to preclude the occurrence of the header at the beginning of a VMC frame. If a compressed data frame began with the header 0×AA 0×FF 0×40 {0×00,0×01} then the first pitch lag $P_L[0]$ would have an inadmissible value of 126. Hence, a compressed data frame uncorrupted by bit or framing errors cannot begin with the header pattern, and so the decoder can differentiate between headers and data frames.

5.2 Synchronization Protocol

In this section, the protocol necessary to synchronize VMC encoders and decoders is defined. A succinct description of the protocol is facilitated by the following definitions. Let the sequence of bytes in a compressed data stream (encoder output/decoder input) be denoted by:

$$\{b_k\}_{k=0}^{N-1} \tag{49}$$

where the length of the compressed message is N bytes. Note that in the state diagrams used to illustrate the synchronization protocol k is used as an index for the compressed byte sequence, that is k points to the next byte in the stream to be processed.

The index i counts the data frames, F[i], contained in the compressed byte sequence. The byte sequence $b_k$ consists of the set of data frames $F[i]_{i=0}^{M-1}$ punctuated by headers, denoted by H. Headers of the form 0×AA 0−FF 0×40 0×01 followed by the reset control word 0×00 0×01 are referred to as reset headers and are denoted by Hr. Alternate headers (0×AA 0×FF 0×40 0×00) are denoted by Hc and are referred to as continue headers. The symbol Lh refers to the length in bytes of the most recent header detected in the compressed byte stream including the control field if present. For a reset header (Hr) Lh=6 and for a continue header (Hc) Lh=4.

The $i^{th}$ data frame F[i] can be regarded as an array of 48 bytes:

$$F[i]^T=[b_{k_i}, b_{k_i+1}, \ldots, b_{k_i+47}] \tag{50}$$

For convenience in describing the synchronization protocol two other working vectors will be defined. The first contains the next six bytes in the compressed data stream:

$$V[k]^T=[b_k, b_{k+1}, \ldots, b_{k+5}], \tag{51}$$

and the second contains the next 48 bytes in the compressed data stream:

$$U[k]^T=[b_k, b_{k+1}, \ldots, b_{k+47}]. \tag{52}$$

The vector V[k] is a candidate for a header (including the optional control field). The logical proposition V[k]≡H is true if the vector contains either type of header. More formally, the proposition is true if either $$V[k]^T=[0\times AA, 0\times FF, 0\times 40, 0\times 00, XX, XX], \tag{53}$$

or $$V[k]^T=[0\times AA, 0\times FF, 0\times 40, 0\times 01, 0\times 00, 0\times 01] \tag{54}$$

is true. Finally, the symbol I is used to denote an integer in the set {1,2,3,4}.

6.2.1 Synchronization Protocol—Rules for the Encoder

For the encoder, the synchronization protocol makes few demands:

1) Inject a reset header Hr at the beginning of each compressed voice message.
2) Inject a continue header Hc at the end of every fourth compressed data frame.

Figure 10:
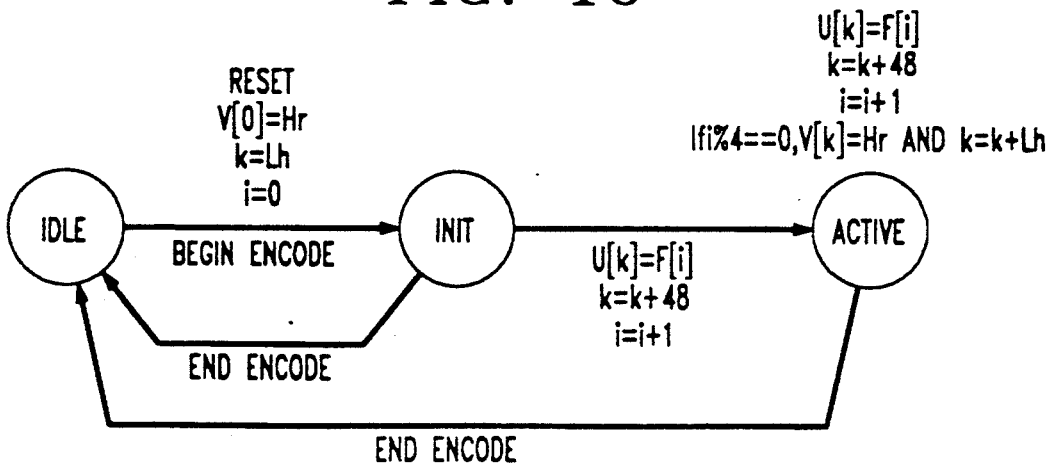
FIG. 10 is an encoder state control diagram useful in understanding aspects of the operation of the coder in the illustrative system of FIG. 1.

The encoder operation is more completely described by the state machine shown in FIG. 10. In the state diagram, the conditions that stimulate state transitions are written in Constant Width font while operations executed as a result of a state transition are written in Italics.

The encoder has three states: Idle, Init and Active. A dormant encoder remains in the Idle state until instructed to begin encoding. The transition from the Idle to Init states is executed on command and results in the following operations:

The encoder is reset.
A reset header is prepended onto the compressed byte stream.
The frame (i) and byte stream (k) indices are initialized.

Once in the Init state, the encoder produces the first compressed frame (F[0]). Note that in the Init state, interpolation of the reflection coefficients is inhibited since there are no precedent coefficients with which to perform the average. An unconditional transition is made from the Init state to the Active state unless the encode operation is terminated by command. The Init to Active state transition is accompanied by the following operations:

Append F[0] onto the output byte stream.
Increment the frame index (i=i+1).
Update the byte index (k=k+48).

The encoder remains in the Active state until instructed to return to the Idle state by command. Encoder operation in the Active state is summarized thusly:

Append the current frame F[i] onto the output byte stream.
Increment the frame index (i=i+1).
Update the byte index (k=k+48).
If i is divisible by 4, append a continue header Hc onto the output byte stream and update the byte count accordingly.

6.2.2 Synchronization Protocol—Rules for the Decoder

Figure 11:
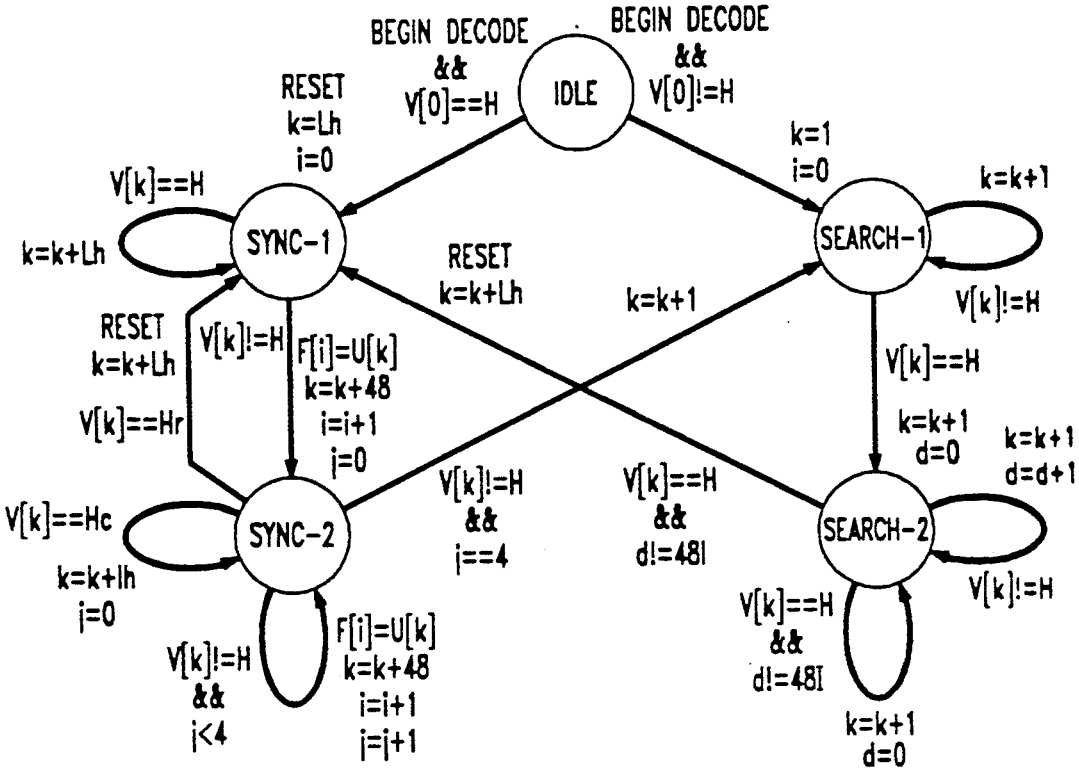
FIG. 11 is a decoder state control diagram useful in understanding aspects of the operation of the decoder in the illustrative system of FIG. 1.

Since the decoder must detect rather than define frame boundaries, the synchronization protocol places greater demands on the decoder than the encoder. The decoder operation is controlled by the state machine shown in FIG. 11. The operation of the state controller for decoding a compressed byte stream proceeds thusly. First, the decoder achieves synchronization by either finding a header at the beginning of the byte stream or by scanning through the byte stream until two headers are found separated by an integral number (between one and four) of compressed data frames. Once synchronization is achieved, the compressed data frames are expanded by the decoder. The state controller searches for one or more headers between each frame and if four frames are decoded without detecting a header, the controller presumes that sync has been lost and returns to the scan procedure for regaining synchronization.

Decoder operation starts in the Idle state. The decoder leaves the idle state on receipt of a command to begin operation. The first four bytes of the compressed data stream are checked for a header. If a header is found, the decoder transitions to the Sync-1 state; otherwise, the decoder enters the Search-1 state. The byte index k and the frame index i are initialized regardless of which initial transition occurs, and the decoder is reset on entry to the Sync-1 state regardless of the type of header detected at the beginning of the file. In normal operation, the compressed data stream should begin with a reset header (Hr) and hence resetting the decoder forces its initial state to match that of the encoder that produced the compressed message. On the other hand, if the data stream begins with a continue header (Hc) then the initial state of the encoder is unobservable and in the absence of a priori information regarding the encoder state, a reasonable fallback is to begin decoding from the reset condition.

If no header is found at the beginning of the compressed data stream, then synchronization with the data frames in the decoder input cannot be assured, and so the decoder seeks to achieve synchronization by locating two headers in the input file separated by an integral number of compressed data frames. The decoder remains in the Search-1 state until a header is detected in the input stream, this forces the transition to the Search-2 state. The byte counter d is cleared when this transition is made. Note that the byte count k must be incremented as the decoder scans through the input stream searching for the first header. In the Search-2 state, the decoder continues to scan through the input stream until the next header is found. During the scan, the byte index k and the byte count d are incremented. When the next header is found, the byte count d is checked. If d is equal to 48, 96, 144 or 192, then the last two headers found in the input stream are separated by an integral number of data frames and synchronization is achieved. The decoder transitions from the Search-2 state to the Sync-1 state, resetting the decoder state and updating the byte index k. If the next header is not found at an admissible offset relative to the previous header, then the decoder remains in the Search-2 state resetting the byte count d and updating the byte index k.

The decoder remains in the Sync-1 state until a data frame is detected. Note that the decoder must continue to check for headers despite the fact that the transition into this state implies that a header was just detected since the protocol accommodates adjacent headers in the input stream. If consecutive headers are detected, the decoder remains in the Sync-1 state updating the byte index k accordingly. Once a data frame is found, the decoder processes that frame and transitions to the Sync-2 state. When in the Sync-1 state interpolation of the reflection coefficients is inhibited. In the absence of synchronization faults, the decoder should transition from the Idle state to the Sync-1 state to the Sync-2 state and the first frame processed with interpolation inhibited corresponds to the first frame generated by the encoder also with interpolation inhibited. The byte index k and the frame index i are updated on this transition.

A decoder in normal operation will remain in the Sync-2 state until termination of the decode operation. In this state, the decoder checks for headers between data frames. If a header is not detected, and if the header counter j is less than 4, the decoder extracts the next frame from the input stream, and updates the byte index k, frame index i and header counter j. If the header counter is equal to four, then a header has not been detected in the maximum specified interval and sync has been lost. The decoder then transitions to the Search-1 state and increments the byte index k. If a continue header is found, the decoder updates the byte index k and resets the header counter j. If a reset counter is detected, the decoder returns to the Sync-1 state while updating the byte index k. A transition from any decoder state to Idle can occur on command. These transitions were omitted from the state diagram for the sake of greater clarity.

In normal operation, the decoder should transition from the Idle state to Sync-1 to Sync-2 and remain in the latter state until the decode operation is complete. However, there are practical applications in which a decoder must process a compressed voice message from random point within the message. In such cases, synchronization must be achieved by locating two headers in the input stream separated by an integral number of frames. Synchronization could be achieved by locating a single header in the input file, but since the protocol does not preclude the occurrence of headers within a data frame, synchronization from a single header encumbers a much higher chance of mis-synchronization. Furthermore, a compressed file may be corrupted in storage or during transmission and hence by the decoder should continually monitor for headers to detect quickly a loss of sync fault.

The illustrative embodiment described in detail should be understood to be only one application of the many features and techniques covered by the present invention. Likewise, many of the system elements and method step described will have utility (individually and in combination) aside from use in the systems and methods illustratively described. In particular, it should be understood that various system parameter values, such as sampling rate and codevector length will vary in particular applications of the present invention, as will occur to those skilled in the art.

APPENDIX A

REFLECTION COEFFICIENT QUANTIZER OUTPUT LEVEL TABLE

The values in the following table represent the output levels of the reflection coefficient scalar quantizers for an illustrative reflection coefficient representable by 6 bits.

| | | | | |
|---|---|---|---|---|
| −0.996429443 | −0.993591309 | −0.990692139 | −0.987609863 | −0.984527588 |
| −0.981475830 | −0.978332520 | −0.974822998 | −0.970947266 | −0.966705322 |
| −0.962249756 | −0.957916260 | −0.953186035 | −0.948211670 | −0.943328857 |
| −0.938140869 | −0.932373047 | −0.925750732 | −0.919525146 | −0.912933350 |
| −0.905639648 | −0.897705078 | −0.889526367 | −0.881072998 | −0.872589111 |
| −0.862670898 | −0.853210449 | −0.843261719 | −0.832550049 | −0.820953369 |
| −0.809082031 | −0.796386719 | −0.781402588 | −0.766510010 | −0.751739502 |
| −0.736114502 | −0.719085693 | −0.701995850 | −0.682739258 | −0.661926270 |
| −0.640228271 | −0.618072510 | −0.588256836 | −0.560516357 | −0.526947021 |
| −0.493225098 | −0.457885742 | −0.418609619 | −0.375732422 | −0.328002930 |
| −0.273773193 | −0.217437744 | −0.166534424 | −0.102905273 | −0.048583984 |
| 0.005310059 | 0.080017090 | 0.155456543 | 0.229919434 | 0.301239014 |
| 0.388305664 | 0.481353760 | 0.589721680 | 0.735961914 | |

APPENDIX B

REFLECTION COEFFICIENT QUANTIZER CELL BOUNDARY TABLE

The values in this table represent the quantization decision thresholds between adjacent quantizer output levels shown in Appendix A (i.e., the boundaries between adjacent quantizer cells).

| | | | | |
|---|---|---|---|---|
| −0.995117188 | −0.992218018 | −0.989196777 | −0.986114502 | −0.983032227 |
| −0.979949951 | −0.976623535 | −0.972900391 | −0.968841553 | −0.964508057 |
| −0.960113525 | −0.955566406 | −0.950744629 | −0.945800781 | −0.940765381 |
| −0.935272217 | −0.929077148 | −0.922668457 | −0.916259766 | −0.909332275 |
| −0.901702881 | −0.893646240 | −0.885314941 | −0.876861572 | −0.867675781 |
| −0.857971191 | −0.848266602 | −0.837951660 | −0.826812744 | −0.815063477 |
| −0.802795410 | −0.788940430 | −0.774017334 | −0.759185791 | −0.743988037 |
| −0.727661133 | −0.710601807 | −0.692413330 | −0.672393799 | −0.651153564 |
| −0.629211426 | −0.603271484 | −0.574462891 | −0.543823242 | −0.510192871 |
| −0.475646973 | −0.438323975 | −0.397277832 | −0.351989746 | −0.300994873 |
| −0.245697021 | −0.192047119 | −0.134796143 | −0.075775146 | −0.021636963 |
| 0.042694092 | 0.117828369 | 0.192840576 | 0.265777588 | 0.345153809 |
| 0.435424805 | 0.536651611 | 0.666046143 | | |

I claim:

1. A method of processing a sequence of input samples comprising gain adjusting each of a plurality of codevectors in a backward adaptive gain controller to produce corresponding gain-adjusted codevectors, each of said codevectors being identified by a corresponding index, filtering each of said gain-adjusted codevectors in a synthesis filter characterized by a plurality of filter parameters to generate candidate codevectors, the synthesis filter comprising a short term synthesis filter and a long term synthesis filter, the long term synthesis filter being forward adaptive, comparing said sequence of input samples with each of said candidate codevectors to determine, for said sequence of input samples, a candidate codevector substantially approximating said sequence of input samples, and outputting (i) the index for the candidate codevector, and (ii) the parameters of said long term synthesis filter.

2. The method of claim 1 wherein said synthesis filter comprises a long-term filter component and a short-term filter component, each of said filter components being characterized by a respective plurality of filter parameters, and wherein adjusting the parameters of said synthesis filter comprises adjusting the parameters of each of said filter components based on a linear predictive analysis of said sequence of input samples.

3. The method of claim 2 wherein said sequence of input samples is a current sequence of input samples in a plurality of consecutive sequences of input samples, said plurality of sequences of input samples including at least one sequence of input samples preceding the current sequence of input samples, and said linear predictive analysis of said input samples comprises grouping the plurality of consecutive sequences of input samples into a frame of input samples, each of said sequences of input samples thereby comprising a sub-frame, determining a set of Nth order predictor coefficients corresponding to said frame of input samples wherein N is the number of predictor coefficients.

4. The method of claim 3, wherein said determining said set of Nth order predictor coefficients, comprises performing an autocorrelation analysis of said frame of input samples to generate a set of autocorrelation coefficients, and recursively forming said predictor coefficients based on said autocorrelation coefficients.

5. The method of claim 3, further comprising weighting said frame of input samples to form a weighted frame of input samples prior to determining said Nth order predictor coefficients, and wherein said determining said set of Nth order predictor coefficients, comprises performing an autocorrelation analysis of said weighted frame of input samples to generate an ordered set of autocorrelation coefficients, and performing a Levinson-Durbin recursion based on said autocorrelation coefficients to determine said set of predictor coefficients.

6. The method of claim 5, further comprising modifying said autocorrelation coefficients to reflect the addition of a small amount of white noise.

7. The method of claim 6, wherein said modifying comprises changing the first of said autocorrelation coefficients by a small factor.

8. The method of claim 7, further comprising the step of modifying the bandwidth of the set of predictor coefficients, thereby expanding the spectral peaks of said synthesis filter.

9. The method of claim 3, further comprising recursively converting said set of predictor coefficients into a set of reflection coefficients according to $$(\text{for } m = 10, 9, 8, \ldots, 1)$$

$$\hat{k}_m = \hat{a}_m^{(m)}$$

$$\hat{a}_i^{(m-1)} = \frac{\hat{a}_i^{(m)} - \hat{k}_m \hat{a}_{m-i}^{(m)}}{1 - \hat{k}_m^2}, \; i = 1, 2, \ldots, m-1.$$

where, $k_m$ is the m-th reflection coefficient and $a_i^{(m)}$ is the i-th coefficient of the m-th order predictor.

10. The method of claim 9 wherein each of said frames comprises S sub-frames and said method further comprises weighting said frame of input samples, thereby forming weighted input samples, prior to determining said Nth order predictor coefficients, and determining predictor coefficients for each weighted sub-frame of input samples based on an interpolation of predictor coefficients determined for a current frame and the predictor coefficients for the immediately preceding frame.

11. The method of claim 10 wherein

S=4, so that each of said frames comprises four sub-frames of input samples, said weighting is in accordance with a shaped weighting window function centered on the fourth of said sequences of input samples, and said interpolation is performed in accordance with $$k_m(j) = \left(1 - \frac{j}{4}\right)\bar{k}_m + \frac{j}{4}\bar{k}_m, \; m = 1, 2, \ldots, 10, \text{ and } j = 1, 2, 3, 4,$$

where $\bar{k}_m$ and $k_m$ are the m-th quantized reflection coefficients of the previous frame and the current frame, respectively, and $k_m(j)$ is the interpolated m-th reflection coefficient for the j-th weighted sequence of input samples.

12. The method of claim 9, comprising the further step of quantizing said set of reflection coefficients by comparing each of said reflection coefficients with indexed elements of threshold values identifying quantizer cell boundaries, thereby to determine an index identifying a quantizer cell, and based on the index identified for each reflection coefficient, assigning a quantizer output value corresponding to a quantizer cell.

13. The method of claim 12, wherein each of said threshold values is an inverse transform value of a quantizer cell boundary value from a transform domain range of values.

14. The method of claim 12, wherein said indexed elements of threshold values are stored in an ordered table of threshold values, with each threshold value having a uniquely associated index, and said comparing to determine an index value comprises searching of values in said table to find a value meeting a predetermined criterion.

15. The method of claim 14, wherein said searching comprises a binary tree search of said table based on the value of said reflection coefficients.

16. The method of claim 2, wherein said adjusting of the parameters of said long-term filter further comprises extracting a pitch lag parameter based on said linear predictive analysis of each of said sequences of input samples, and wherein said outputting parameters of said synthesis filter comprises outputting a coded representation of said pitch lag parameter for each sequence of input samples.

17. The method of claim 2, wherein said adjusting of the parameter of said long-term filter further comprises grouping a plurality of consecutive sequences of input samples into a frame of input samples, each of said sequences of input samples thereby comprising a sub-frame extracting a pitch lag parameter for each subframe based on said linear predictive analyses of said subframe, and wherein said outputting parameters of said synthesis filter comprises outputting a coded representation of said pitch lag parameter and said pitch predictor tap weights for each subframe.

18. The method of claim 17, wherein said extracting of a pitch lag parameter comprises generating a set of signals representing LPC residuals for the current subframe of input samples, forming a cross correlation, for each of a range of lag values, based on said LPC residuals for the current frame and the LPC residuals for a plurality of prior subframes, selecting a pitch lag parameter based on the lag value of said cross correlation having the largest value.

19. The method of claim 18, wherein said LPC residuals for said current subframe and for said prior subframes are time decimated prior to said cross correlation, and said method further comprises adjusting said selected value of said lag parameter to reflect the time decimation.

20. The method of claim 17, wherein said plurality of tap weights comprises three tap weights, said long-term filter component has a transfer function given by $$P_1(z) = \sum_{i=1}^{3} b_1 z^{-p+2-i}.$$

said storing one or more pitch tap vectors corresponding to each possible set of quantized tap weights comprises storing a vector given by $$y = [2b_1, 2b_2, 2b_3, -2b_1b_2, -2b_2b_3, -2b_3b_1, -b_1^2, -b_2^2, -b_3^2]^T.$$

21. The method of claim 1 wherein said sequence of input samples is a current sequence of input samples in a plurality of consecutive sequences of input samples, said plurality of consecutive sequences of input samples having at least one sequence of input samples preceding said current sequence of input samples, said synthesis filter comprising memory, said memory storing a residual signal reflecting codevector information corresponding to said at least part of at least one sequence of input samples preceding said current sequence of input samples, said residual signal giving rise to a contribution to said candidate codevectors, the method further comprising removing said contribution to said candidate codevectors prior to said comparing.

22. The method of claim 1, wherein said comparing comprises perceptually weighting said input samples and said candidate codevectors prior to said comparing.

23. The method of claim 22 wherein said sequence of input samples is a current sequence of input samples in a plurality of consecutive sequences of input samples, said plurality of consecutive sequences of input samples havinq at least one sequence of input samples preceding said current sequence of input samples, said synthesis filter comprising memory, said memory storinq a residual signal reflecting codevector information corresponding to said at least part of at least one sequence of input samples preceding said current sequence of input samples, said residual signal giving rise to a contribution to said candidate codevectors, the method further comprising removing said contribution to said candidate codevectors prior to said comparing.

24. The method of claim 1 wherein said plurality of codevectors comprises M/2 linearly independent codevectors, where M is the number of codevectors that are gain adjusted, said comparing comprises comparing M codevectors, said M codevectors being based on said M/2 linearly independent codevectors and each of two sign values for said codevectors.

25. The method of claim 1, wherein said backward adaptive gain controller is adaptively adjusted by the further step of passing gain information relating to said codevector corresponding to said outputted index through said gain controller.

26. The method of claim 1 further comprising storing said outputted index and parameters.

27. The method of claim 1 further comprising transmitting said outputted index and parameters to a communications medium.

28. The method of claim 1 for processing a set of additional sequences of input samples, the set of additional sequences of input samples being subsequent to the sequence of input samples previously processed, the method comprising:

(a) adjusting the parameters of the synthesis filter in response to a previous sequence of input samples;

(b) repeating the steps of gain adjusting, filtering, comparing, and outputting for a next sequence of input samples from the set of additional sequences of input samples; and (c) repeating steps (a) and (b) until each sequence in the set of additional sequences of input samples has been processed.

29. The method of claim 1 wherein the step of comparing further comprises determining the candidate codevector having the minimum difference relative to the sequence of input samples.

30. A method of processing a sequence of input samples comprising:

(a) gain adjusting the sequence of input samples in a backward adaptive gain controller to produce a gain-adjusted sequence of input samples;

(b) filtering each of a plurality of codevectors in a synthesis filter characterized by a plurality of filter parameters to generate a plurality of candidate codevectors, the synthesis filter comprising a short term synthesis filter and a long term synthesis filter, the long term synthesis filter being forward adaptive, each of the plurality of codevectors having an index associated therewith;

(c) comparing the plurality of candidate codevectors with the gain-adjusted sequence of input samples to determine a candidate codevector substantially approximating the gain-adjusted sequence of input samples; and (d) outputting (i) the index associated with the candidate codevector substantially approximating the gain-adjusted sequence of input samples; and (ii) the parameters of said long term synthesis filter.

31. The method of claim 30 for processing a set of additional sequences of input samples, the set of additional sequences of input samples being subsequent to the sequence of input samples previously processed, the method comprising:

(a) adjusting the parameters of the synthesis filter in response to a previous sequence of input samples;

(b) repeating steps (a) through (d) for a next sequence of input samples from the set of additional sequences of input samples; and (c) repeating steps (a) and (b) until each additional sequence in the set of additional sequences of input samples has been processed.

32. The method of claim 31 wherein adjusting the parameters of the synthesis filter comprises adjusting parameters of the long term filter comprising:

(a) grouping a plurality of consecutive sequences of input samples into a frame of input samples, each of the sequences of input samples thereby comprising a sub-frame; and (b) extracting a pitch lag parameter for each sub-frame based on the linear predictive analysis of the sub-frame.

33. The method of claim 32 wherein outputting the parameters of the synthesis filter comprises outputting a coded representation of the pitch lag parameter for each sub-frame.

34. The method of claim 30 wherein adjusting the parameters of the synthesis filter is based upon a linear predictive analysis.

35. The method of claim 34 wherein the linear predictive analysis comprises:

(a) grouping a plurality of consecutive sequences of input samples into a frame of input samples;

(b) performing an autocorrelation analysis of the frame of input samples to generate a set of autocorrelation coefficients; and (c) determining a set of Nth order predictor coefficients based on the set of autocorrelation coefficients.

36. The method of claim 30 wherein the step of comparing further comprises determining the candidate codevector having the minimum difference relative to the sequence of input samples.

37. A method of processing a first signal by utilizing a set of second signals, the method comprising:

(a) in a backward adaptive gain controller, producing a gain-adjusted first signal and a gain-adjusted set of second signals;

(b) filtering the gain-adjusted set of second signals in a synthesis filter characterized by a plurality of filter parameters to generate a filtered set of second signals, the synthesis filter comprising a short term synthesis filter and a long term synthesis filter, the long term synthesis filter being forward adaptive, each signal in the filtered set of second signals having an index associated therewith;

(c) comparing each signal in the filtered set of second signals with the gain-adjusted first signal to determine a filtered second signal substantially approximating the gain-adjusted first signal; and (d) outputting (i) the index associated with the filtered second signal; and (ii) the parameters of said long term synthesis filter.

38. The method of claim 32 wherein the step of producing a gain-adjusted first signal comprises leaving the first signal unchanged.

39. The method of claim 32 wherein the step of producing a gain-adjusted set of second signals comprises leaving the set of second signals unchanged.

40. The method of claim 32 for processing a set of additional first signals, the set of additional first signals being subsequent to the first signal previously processed, the method comprising:

(a) adjusting the parameters of the synthesis filter in response to a previous first signal;

(b) repeating steps (a) through (d) of claim 36 for a next first signal from the set of additional first signals; and (c) repeating steps (a) and (b) until each additional first signal in the set of additional first signals has been processed.

41. The method of claim 40 wherein adjusting the parameters of the synthesis filter is based upon a linear predictive analysis.

42. The method of claim 41 wherein the linear predictive analysis comprises:

(a) grouping a plurality of consecutive first signals into a frame of input samples;

(b) performing an autocorrelation analysis of the frame of first signals to generate a set of autocorrelation coefficients; and (c) determining a set of Nth order predictor coefficients based on the set of autocorrelation coefficients.

43. The method of claim 40 wherein adjusting the parameters of the synthesis filter comprises adjusting parameters of the long term filter comprising:

(a) grouping a plurality of consecutive first signals into a frame of input samples, each of the first signals thereby comprising a sub-frame; and (b) extracting a pitch lag parameter for each sub-frame based on the linear predictive analysis of the sub-frame.

44. The method of claim 43 wherein outputting the parameters of the synthesis filter comprises outputting a coded representation of the pitch lag parameter for each sub-frame.

45. The method of claim 32 wherein the step of comparing further comprises determining a filtered second signal in the filtered set of second signals having the minimum difference relative to the first signal.

* * * * *